US011891775B2

(12) United States Patent
Chiba et al.

(10) Patent No.: US 11,891,775 B2
(45) Date of Patent: Feb. 6, 2024

(54) WORK MACHINERY

(71) Applicant: HITACHI CONSTRUCTION MACHINERY CO., LTD., Tokyo (JP)

(72) Inventors: Takaaki Chiba, Ibaraki (JP); Kento Kumagai, Ibaraki (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 355 days.

(21) Appl. No.: 17/436,445

(22) PCT Filed: Aug. 7, 2020

(86) PCT No.: PCT/JP2020/030336
§ 371 (c)(1),
(2) Date: Sep. 3, 2021

(87) PCT Pub. No.: WO2021/059776
PCT Pub. Date: Apr. 1, 2021

(65) Prior Publication Data

US 2022/0186470 A1 Jun. 16, 2022

(30) Foreign Application Priority Data

Sep. 27, 2019 (JP) ..... 2019-176682

(51) Int. Cl.
*E02F 9/20* (2006.01)
*E02F 9/26* (2006.01)
(Continued)

(52) U.S. Cl.
CPC ..... *E02F 9/2033* (2013.01); *E02F 3/435* (2013.01); *E02F 9/24* (2013.01); *E02F 9/26* (2013.01)

(58) Field of Classification Search
CPC . E02F 9/2033; E02F 3/435; E02F 9/24; E02F 9/26; E02F 9/2228; E02F 9/2235;
(Continued)

(56) References Cited

U.S. PATENT DOCUMENTS

2016/0223350 A1* 8/2016 Lewis ..... G08G 1/096725
2017/0068249 A1* 3/2017 Minowa ..... H04W 4/024
(Continued)

FOREIGN PATENT DOCUMENTS

CA 2850076 A1 * 2/2013 ..... G01C 21/3407
JP 09-71965 A 3/1997
(Continued)

OTHER PUBLICATIONS

International Search Report of PCT/JP2020/030336 dated Oct. 20, 2020.

*Primary Examiner* — Peter D Nolan
*Assistant Examiner* — Demetra R Smith-Stewart
(74) *Attorney, Agent, or Firm* — MATTINGLY & MALUR, PC

(57) ABSTRACT

The hydraulic excavator 1 includes a work implement 7, a detection device that detects an obstacle around the hydraulic excavator 1, and a controller 27 that controls the operation of the work implement 7. The controller 27 has a driving assistance function and a work assistance function. The work assistance function is switchable between enabled and disabled. When the work assistance function is switched to enabled, the controller 27 suppresses, for an obstacle detected in a monitoring range but outside of a work range, the driving assistance function in comparison with when the work assistance function is switched to disabled.

3 Claims, 21 Drawing Sheets

(51) Int. Cl.
*E02F 9/24* (2006.01)
*E02F 3/43* (2006.01)

(58) Field of Classification Search
CPC ..... E02F 9/2242; E02F 9/2285; E02F 9/265; E02F 9/262; E02F 3/437; E02F 9/2029; E02F 9/2267; E02F 3/43; E02F 9/2004; E02F 9/2025; G05D 2201/0202
See application file for complete search history.

(56) References Cited

U.S. PATENT DOCUMENTS

2018/0347147 A1 12/2018 Doi et al.
2019/0194913 A1* 6/2019 Petrany ..... E02F 9/205

FOREIGN PATENT DOCUMENTS

JP 2006-257724 A 9/2006
JP 2017-210816 A 11/2017
JP 2018-199989 A 12/2018

* cited by examiner

Work Range Setting Screen

| | |
|---|---|
| Right Side | 2m |
| Left Side | 2m |
| Front | 10m |
| Rear | 2m |

Work Range Setting Screen

| | |
|---|---|
| Upper | 5m |
| Lower | 2m |
| Front | 10m |
| Rear | 2m |

WORK MACHINERY

TECHNICAL FIELD

The present invention relates to a work machinery, and in particular, to a work machinery with a driving assistance function and a work assistance function.

The present application claims priority from Japanese Patent Application No. 2019-176682 filed on Sep. 27, 2019, the entire content of which is hereby incorporated by reference into this application.

BACKGROUND ART

For a work machinery such as a hydraulic excavator, a driving assistance function is known that, upon detecting an obstacle, such as a worker, a passenger, or an object, around the work machinery, alerts an operator or decelerates or stops a work implement, which is a work front of the work machinery, so as to prevent the work implement from hitting the obstacle as described in Patent Literature 1, for example.

In addition, as described in Patent Literature 2, a work assistance function is known that controls a work implement so that the work implement will not deviate from a work range, such as a preset height, depth, or swivel angle. Using such a work assistance function can prevent the work implement in operation from hitting and damaging an electric wire or a buried object, and thus can improve work efficiency. Further, limiting a region of the direction of swivel can prevent the work implement from straying onto a road while working on the side of the road, for example.

CITATION LIST

Patent Literature

Patent Literature 1: JP 2006-257724 A
Patent Literature 2: JP H09-71965 A

SUMMARY OF INVENTION

Technical Problem

However, when a work machinery with the aforementioned driving assistance function and work assistance function is considered, if an operator is alerted to an obstacle detected outside of the work range or deceleration is controlled as is conventionally done regardless of the fact that the work implement is configured to be prevented from deviating from the work range, the operator would feel cumbersome and work efficiency would thus decrease, which are problematic.

In view of the foregoing circumstances, it is an object of the present invention to provide a work machinery with a driving assistance function and a work assistance function that can reduce cumbersomeness for an operator and can prevent a decrease in work efficiency.

Solution to Problem

A work machinery according to the present invention is a work machinery including a work implement as a work front; a detection device configured to detect an obstacle around the work machinery; and a controller configured to control the operation of at least the work implement, in which the controller has a driving assistance function and a work assistance function, the driving assistance function being adapted to, when an obstacle detected by the detection device is in a preset monitoring range, decelerate the work implement or alert an operator, or perform both, and the work assistance function being adapted to prevent the work implement from deviating from a preset work range, the work assistance function is switchable between enabled and disabled, and when the work assistance function is switched to enabled, the controller is configured to, for an obstacle detected in the monitoring range but outside of the work range, suppress the driving assistance function in comparison with when the work assistance function is switched to disabled.

In the work machinery according to the present invention, when the work assistance function is switched to enabled, the controller is configured to, for an obstacle detected in the monitoring range but outside of the work range, suppress the driving assistance function in comparison with when the work assistance function is switched to disabled. Therefore, when the work assistance function is switched to enabled, for example, the controller can reduce the alert volume or increase the deceleration coefficient for an obstacle detected in the monitoring range but outside of the work range in comparison with when the work assistance function is switched to disabled. This can reduce cumbersomeness for an operator and prevent a decrease in work efficiency.

Advantageous Effects of Invention

According to the present invention, a work machinery with a driving assistance function and a work assistance function is provided that can reduce cumbersomeness for an operator and prevent a decrease in work efficiency.

DESCRIPTION OF EMBODIMENTS

Hereinafter, embodiments of a work machinery according to the present invention will be described with reference to the drawings. In the description of the drawings, identical elements are denoted by identical reference signs, and repeated description thereof will be omitted. Although the following description illustrates an example in which the work machinery is a hydraulic excavator, the present invention is not limited thereto, and is also applicable to work machineries other than hydraulic excavators. Further, in the following description, the directions and positions indicated by upper, lower, right, left, front, or rear are based on the state in which the hydraulic excavator is used in the ordinary way, that is, a traveling body touches the ground.

[Regarding Structure of Hydraulic Excavator]

Figure 1:
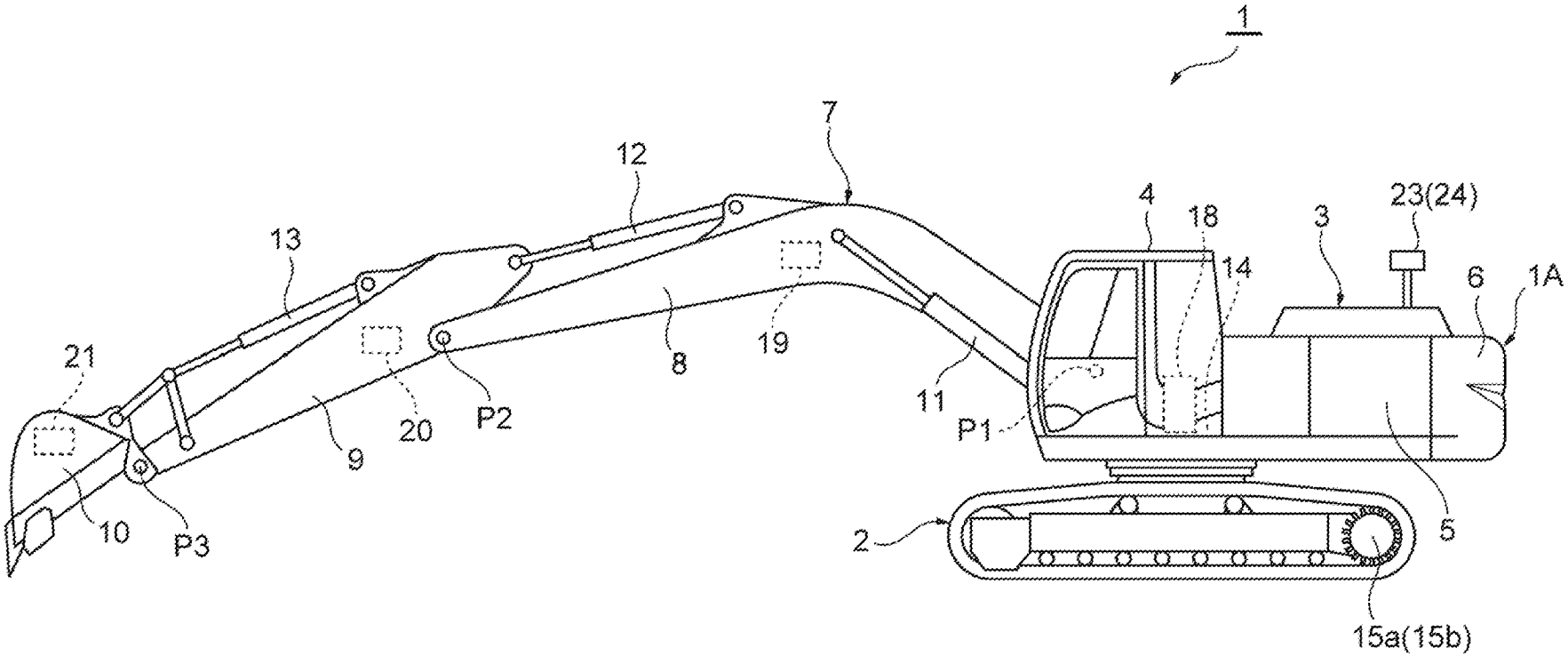
FIG. 1 is a side view illustrating a hydraulic excavator according to an embodiment.

FIG. 1 is a side view illustrating a hydraulic excavator according to an embodiment. A hydraulic excavator 1 according to the present embodiment includes a traveling body 2 that travels with crawler belts provided on its right and left side portions driven, a swivel body 3 provided above the traveling body 2 in a swivellable manner, and a work implement 7 as a work front. The traveling body 2 and the swivel body 3 form a vehicle body 1A of the hydraulic excavator 1.

The swivel body 3 includes an operator's cab 4, an engine room 5, and a counterweight 6. The operator's cab 4 is provided in the left side portion of the swivel body 3. The engine room 5 is provided behind the operator's cab 4. The counterweight 6 is provided behind the engine room 5, that is, in the rearmost portion of the swivel body 3.

The work implement 7 is provided on the right lateral side of the operator's cab 4 and at the center of the front portion of the swivel body 3. The work implement 7 includes a boom 8, an arm 9, a bucket 10, a boom cylinder 11 for driving the boom 8, an arm cylinder 12 for driving the arm 9, and a bucket cylinder 13 for driving the bucket 10. The proximal end of the boom 8 is rotatably attached to the front portion of the swivel body 3 via a boom pin P1.

The proximal end of the arm 9 is rotatably attached to the distal end of the boom 8 via an arm pin P2. The proximal end of the bucket 10 is rotatably attached to the distal end of the arm 9 via a bucket pin P3. Each of the boom cylinder 11, the arm cylinder 12, and the bucket cylinder 13 is a hydraulic actuator driven with pressure oil (hereinafter simply referred to as an "actuator").

The swivel body 3 has a swivel motor 14 disposed therein. When the swivel motor 14 is driven, the swivel body 3 rotates with respect to the traveling body 2. In addition, the traveling body 2 has a right travel motor 15*a* and a left travel motor 15*b* disposed therein. When the travel motors 15*a* and 15*b* are driven, the right and left crawler belts are driven. Accordingly, the traveling body 2 can move forward or backward. It should be noted that each of the swivel motor 14, the right travel motor 15*a*, and the left travel motor 15*b* is a hydraulic actuator driven with pressure oil (hereinafter simply referred to as an "actuator").

Figure 3:
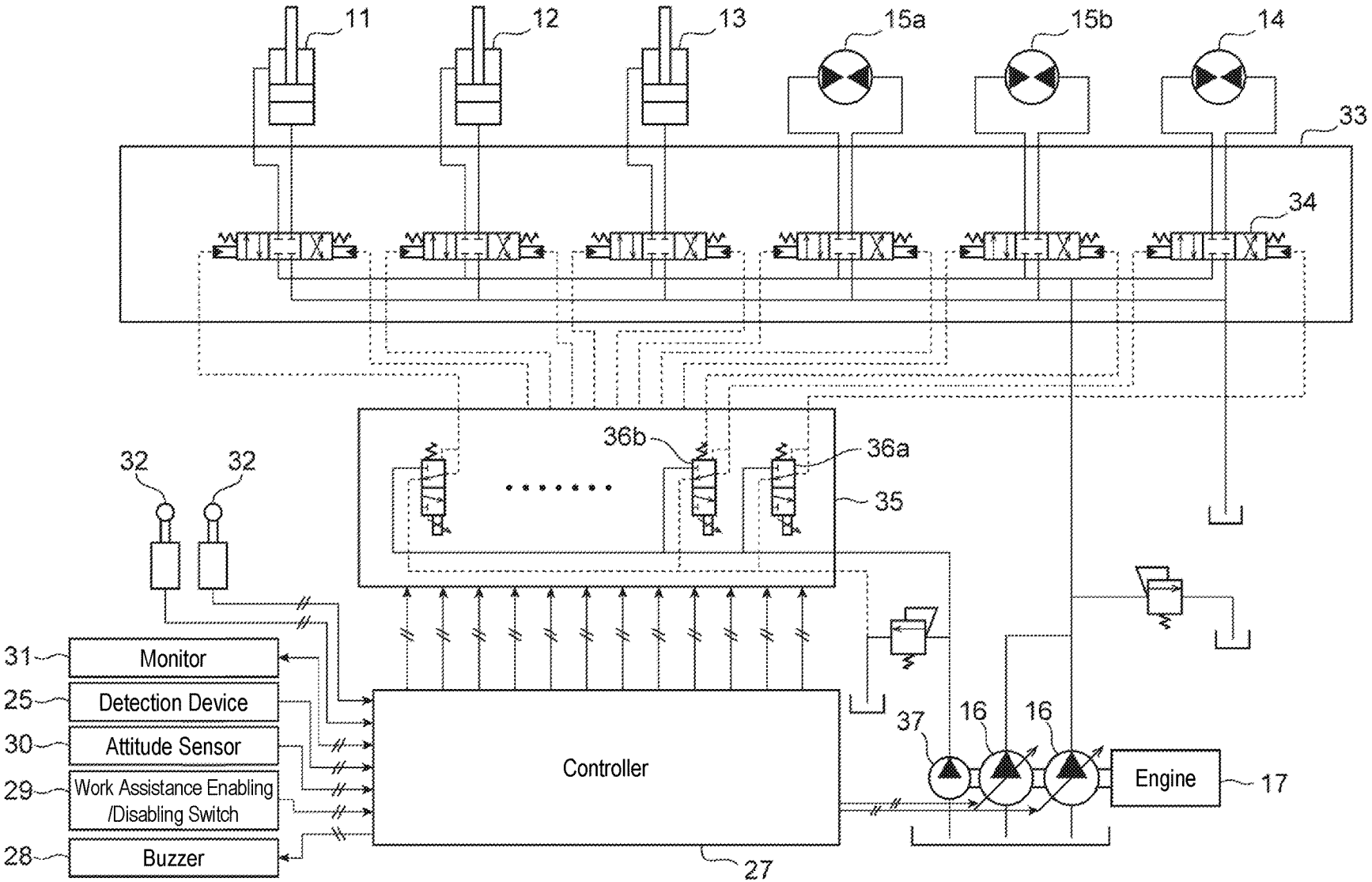
FIG. 3 is a configuration diagram illustrating a system of the hydraulic excavator.

The engine room 5 has a hydraulic pump 16 and an engine 17 disposed therein (see FIG. 3). The operator's cab 4 has a vehicle body tilt sensor 18 attached to its inside, the boom 8 has a boom tilt sensor 19 attached thereto, the arm 9 has an arm tilt sensor 20 attached thereto, and the bucket 10 has a bucket tilt sensor 21 attached thereto. Each of the vehicle body tilt sensor 18, the boom tilt sensor 19, the arm tilt sensor 20, and the bucket tilt sensor 21 includes an IMU (Inertial Measurement Unit), for example. The vehicle body tilt sensor 18 measures the angle of the vehicle body 1A with respect to the ground. The boom tilt sensor 19 measures the angle of the boom 8 with respect to the ground. The arm tilt sensor 20 measures the angle of the arm 9 with respect to the ground. The bucket tilt sensor 21 measures the angle of the bucket 10 with respect to the ground.

In addition, the rear portion of the swivel body 3 has a first GNSS (Global Navigation Satellite System) antenna 23 and a second GNSS antenna 24 attached to its right and left sides. With signals obtained from the first GNSS antenna 23 and the second GNSS antenna 24, the positional information on the vehicle body 1A of the hydraulic excavator 1 on the global coordinate system can be obtained.

Figure 2:
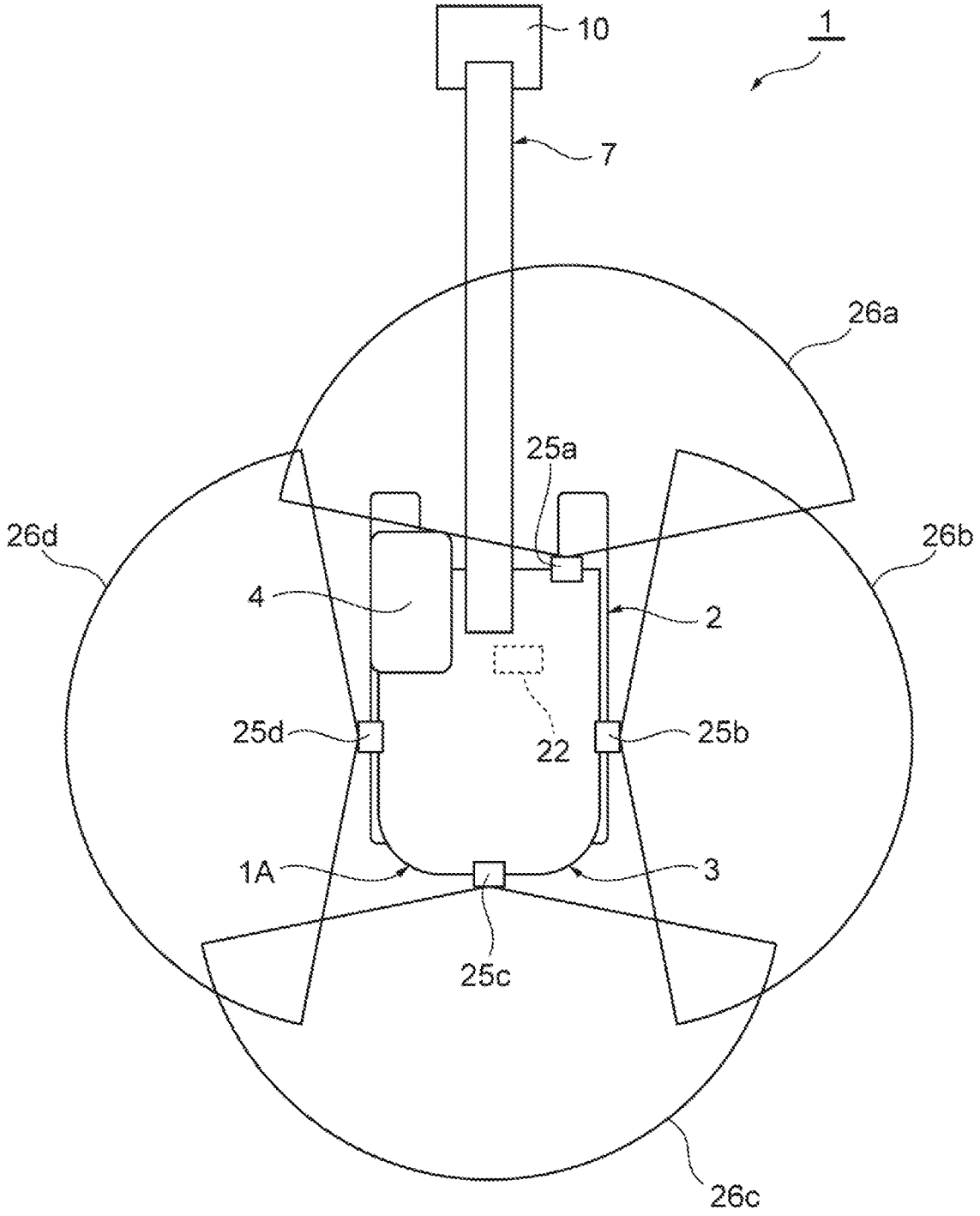
FIG. 2 is a plan view illustrating the hydraulic excavator according to an embodiment.

FIG. 2 is a plan view illustrating the hydraulic excavator according to an embodiment. As illustrated in FIG. 2, the swivel body 3 has a swivel angle sensor 22 attached thereto. With a signal from the swivel angle sensor 22, the relative angle of the swivel body 3 with respect to the traveling body 2 can be obtained.

In addition, the swivel body 3 is provided with a plurality of detection devices for detecting obstacles around the hydraulic excavator 1. Specifically, the front portion of the swivel body 3 has attached hereto a front detection device 25*a* that detects obstacles ahead of the hydraulic excavator 1, the right side portion of the swivel body 3 has attached thereto a right side detection device 25*b* that detects obstacles around the right side of the hydraulic excavator 1, the rear portion of the swivel body 3 has attached thereto a rear detection device 25*c* that detects obstacles behind the hydraulic excavator 1, and the left side portion of the swivel body 3 has attached thereto a left side detection device 25*d* that detects obstacles around the left side of the hydraulic excavator 1.

Each of the detection devices 25*a* to 25*d* includes a stereo camera, for example, and measures the distance between the hydraulic excavator 1 and an obstacle. It should be noted that each detection device may also be a millimeter-wave radar, a laser radar, or a distance measuring device that uses a magnetic field, for example. Examples of the obstacle herein include objects, such as a worker, passenger, tree, building, and road sign.

In FIG. 2, reference numerals 26*a* to 26*d* denote detectable ranges that are detected by the detection devices 25*a* to 25*d*, respectively. That is, the range detected by the front detection device 25*a* is a front detectable range 26*a*, the range detected by the right side detection device 25*b* is a right side detectable range 26*b*, the range detected by the rear detection device 25*c* is a rear detectable range 26*c*, and the range detected by the left side detection device 25*d* is a left side detectable range 26*d*.

FIG. 3 is a configuration diagram illustrating a system of the hydraulic excavator. As illustrated in FIG. 3, the boom cylinder 11, the arm cylinder 12, the bucket cylinder 13, the swivel motor 14, the right travel motor 15*a*, and the left travel motor 15*b* are driven with pressure oil that has been discharged by the hydraulic pump 16 and further supplied through respective flow rate control valves in a flow rate control valve unit 33. Each flow rate control valve is adapted to control the flow rate of pressure oil supplied from the hydraulic pump 16, and is driven with a control pilot pressure output from an operating lever 32.

For example, a swivel flow rate control valve 34 is a control valve corresponding to the swivel motor 14, and controls the flow rate of pressure oil to be supplied to the swivel motor 14. When the swivel flow rate control valve 34 moves to the left in FIG. 3, pressure oil is supplied so as to allow the swivel motor 14 to rotate leftward. The rotational speed of the swivel motor 14 is controlled based on the movement amount of the swivel flow rate control valve 34. Meanwhile, when the swivel flow rate control valve 34 moves to the right in FIG. 3, pressure oil is supplied so as to allow the swivel motor 14 to rotate rightward.

The swivel flow rate control valve 34 is controlled by a proportional solenoid pressure-reducing valve in a proportional solenoid pressure-reducing valve unit 35. The proportional solenoid pressure-reducing valve is adapted to reduce the pressure of pressure oil supplied from a pilot hydraulic pump 37 in accordance with a control command from a controller 27, and supply the resulting pressure oil to the corresponding flow rate control valve. For example, when a left-swivel proportional solenoid pressure-reducing valve 36*a* is driven, pressure oil is supplied so as to allow the swivel flow rate control valve 34 to move to the left in FIG. 3. Meanwhile, when a right-swivel proportional solenoid pressure-reducing valve 36*b* is driven, pressure oil is supplied so as to allow the swivel flow rate control valve 34 to move to the right in FIG. 3.

The controller 27 includes a microcomputer formed by combining a CPU (Central Processing Unit) that executes arithmetic operation, a ROM (Read Only Memory) as a secondary storage device having recorded thereon programs for arithmetic operation, and a RAM (Random Access Memory) as a temporary storage device for storing the progress of arithmetic operation and also storing temporal control variables, for example. The controller 27 executes various control processes for the entire hydraulic excavator 1 including the process of controlling the operation of the work implement 7. For example, as illustrated in FIG. 3, the controller 27 computes control signals for the proportional solenoid pressure-reducing valve unit 35, the hydraulic pump 16, and a buzzer 28 based on signals output from the operating lever 32, a monitor 31, an attitude sensor 30, and a work assistance enabling/disabling switch 29, and then outputs the computed control signals.

The operating lever 32 is disposed in the operator's cab 4, and informs the controller 27 of the operation amount for each actuator (i.e., the boom cylinder 11, the arm cylinder 12, the bucket cylinder 13, the swivel motor 14, the right travel motor 15*a*, and the left travel motor 15*b*). The monitor 31 is disposed in the operator's cab 4, and is used to set a work range for a work assistance function. The work range is set manually by the operator, for example, which will be described in detail later (see FIG. 13).

The work assistance enabling/disabling switch 29 is disposed in the operator's cab 4, and is configured to switch between enabling and disabling the work assistance function in response to an operation of the operator. The attitude sensor 30 includes the swivel angle sensor 22, for example. The buzzer 28 alerts the operator to take precautions according to the distance between the hydraulic excavator 1 and an obstacle.

In the present embodiment, the controller 27 has a driving assistance function and a work assistance function. The driving assistance function is a function of detecting an obstacle around the hydraulic excavator 1 using the detection devices 25*a* to 25*d* provided in the hydraulic excavator 1 and, if the detected obstacle is in a preset monitoring range, decelerating the work implement 7 or alerting the operator, or performing both. Meanwhile, the work assistance function is a function of preventing the work implement 7 from deviating from a preset work range. Hereinafter, such functions will be described in detail.

[Regarding Driving Assistance Function of Hydraulic Excavator]

First, the driving assistance function of the hydraulic excavator 1 will be described.

Figure 4:
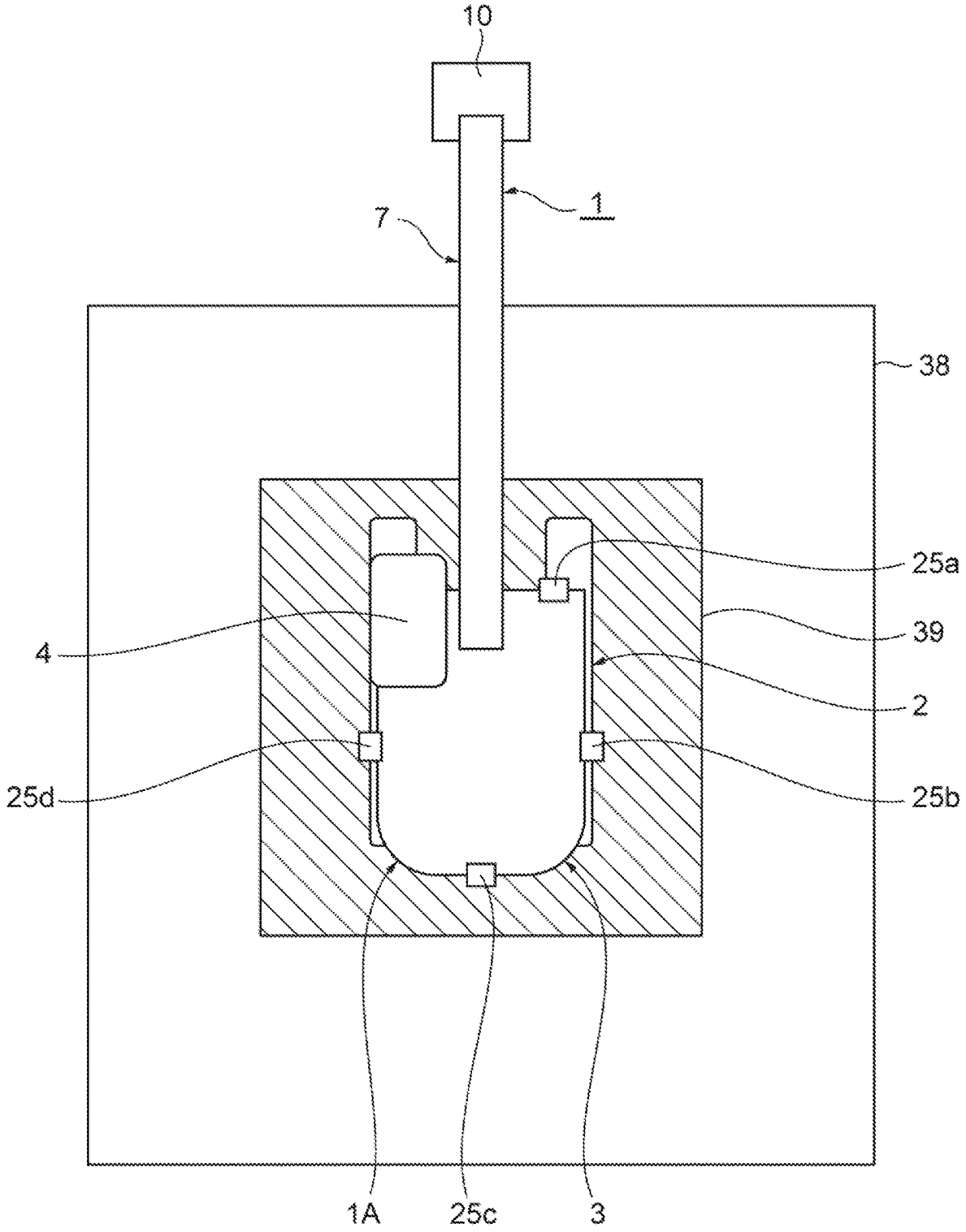
FIG. 4 is a plan view for illustrating a driving assistance function of the hydraulic excavator.

FIG. 4 is a plan view for illustrating the driving assistance function of the hydraulic excavator. A diagonally shaded region 39 in FIG. 4 is a deceleration region. When an obstacle is present in the region, the operation of the work implement 7 is decelerated, and also, the buzzer 28 issues an alert to the operator. In addition, a region 38 within a quadrangular frame surrounding the deceleration region 39 in FIG. 4 is an alert region. When an obstacle is present in the alert region 38, the buzzer 28 issues an alert. It should be noted that the alert region 38 and the deceleration region 39 form the aforementioned monitoring range.

Figure 5:
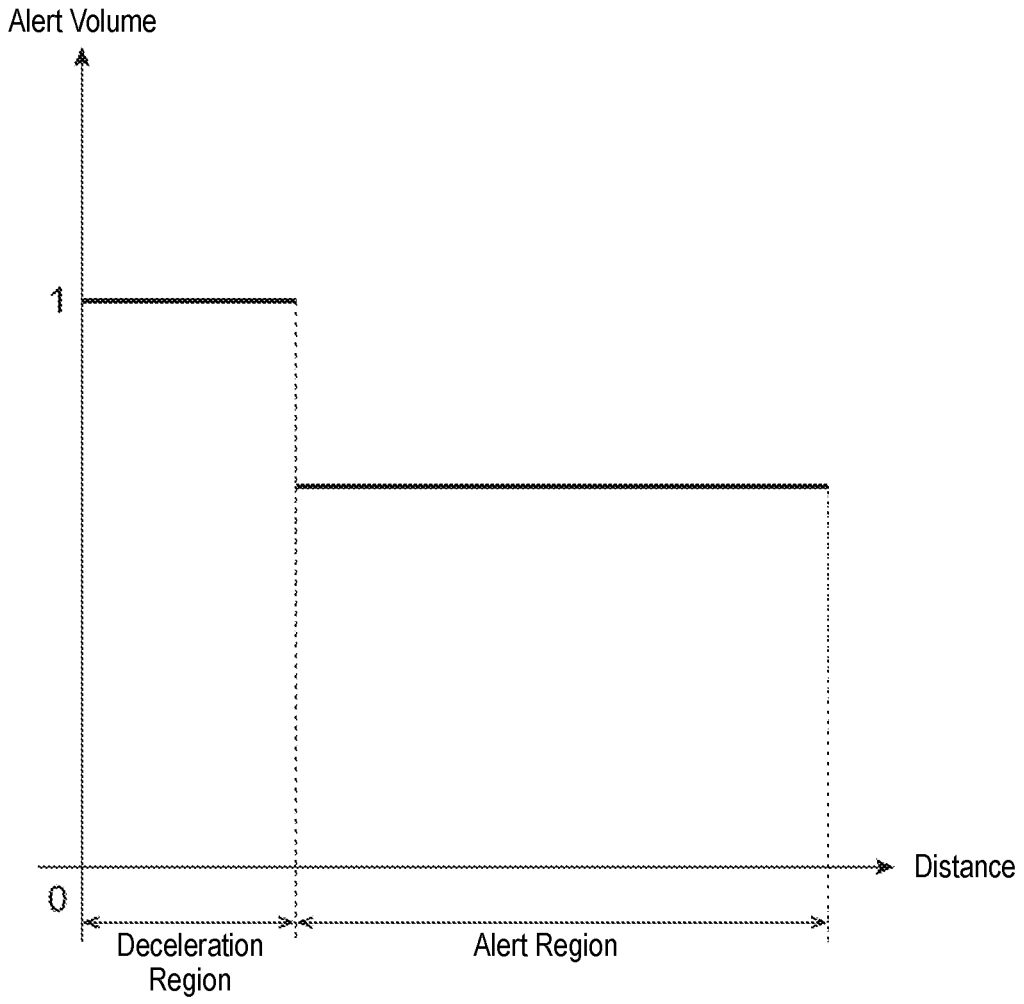
FIG. 5 is a graph illustrating the relationship between the distance between the hydraulic excavator and an obstacle and the alert volume.

FIG. 5 is a graph illustrating the relationship between the distance between the hydraulic excavator and an obstacle and the alert volume. In FIG. 5, the "distance" of the abscissa axis is the abbreviation of the distance between the hydraulic excavator and an obstacle. As illustrated in FIG. 5, the alert volume of the buzzer is usually determined according to the distance between the hydraulic excavator and an obstacle. For example, provided that the alert volume in the deceleration region is 1, the alert volume in the alert region is set smaller than that in the deceleration region. In this manner, varying the alert volume in different regions allows the operator to intuitively understand the position of the obstacle based on the difference in the volume.

Figure 6:
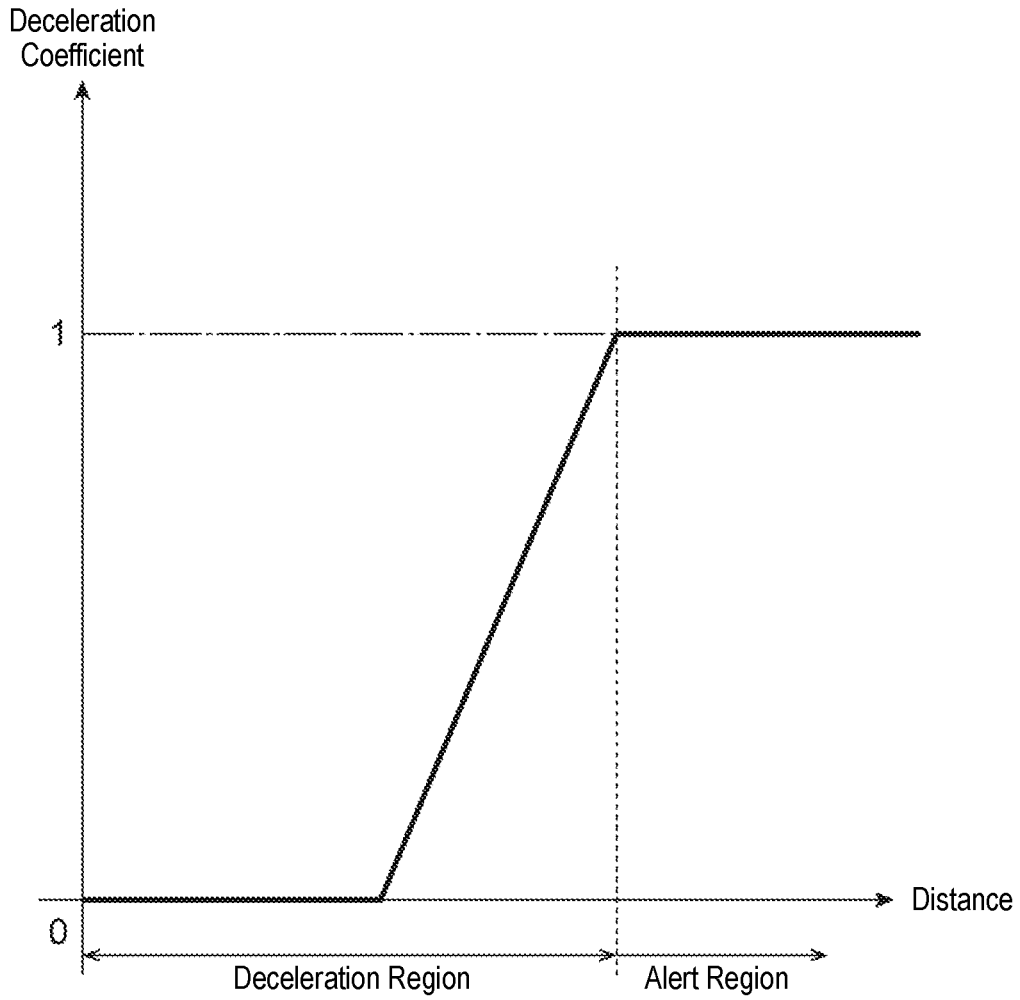
FIG. 6 is a graph illustrating the relationship between the distance between the hydraulic excavator and an obstacle and a deceleration coefficient.

FIG. 6 is a graph illustrating the relationship between the distance between the hydraulic excavator and an obstacle and a deceleration coefficient. In FIG. 6, the "distance" of the abscissa axis is the abbreviation of the distance between the hydraulic excavator and an obstacle. As illustrated in FIG. 6, when an obstacle is present in the deceleration region, as the distance becomes shorter, the deceleration coefficient for each actuator usually becomes smaller, and accordingly, the movement of the work implement becomes gradual (that is, the movement of the work implement becomes slow). This can prevent contact between the hydraulic excavator and the obstacle.

Herein, the deceleration coefficient indicates the degree of deceleration of the requested speed of each actuator determined based on the operation amount of the operating lever. In addition, a limited speed can be determined as the product of the requested speed and the deceleration coefficient. For example, when the deceleration coefficient is 1, the requested speed of each actuator is not limited, while when the deceleration coefficient is zero, the limited speed is zero, which means that the actuator stops operation.

Figure 7:
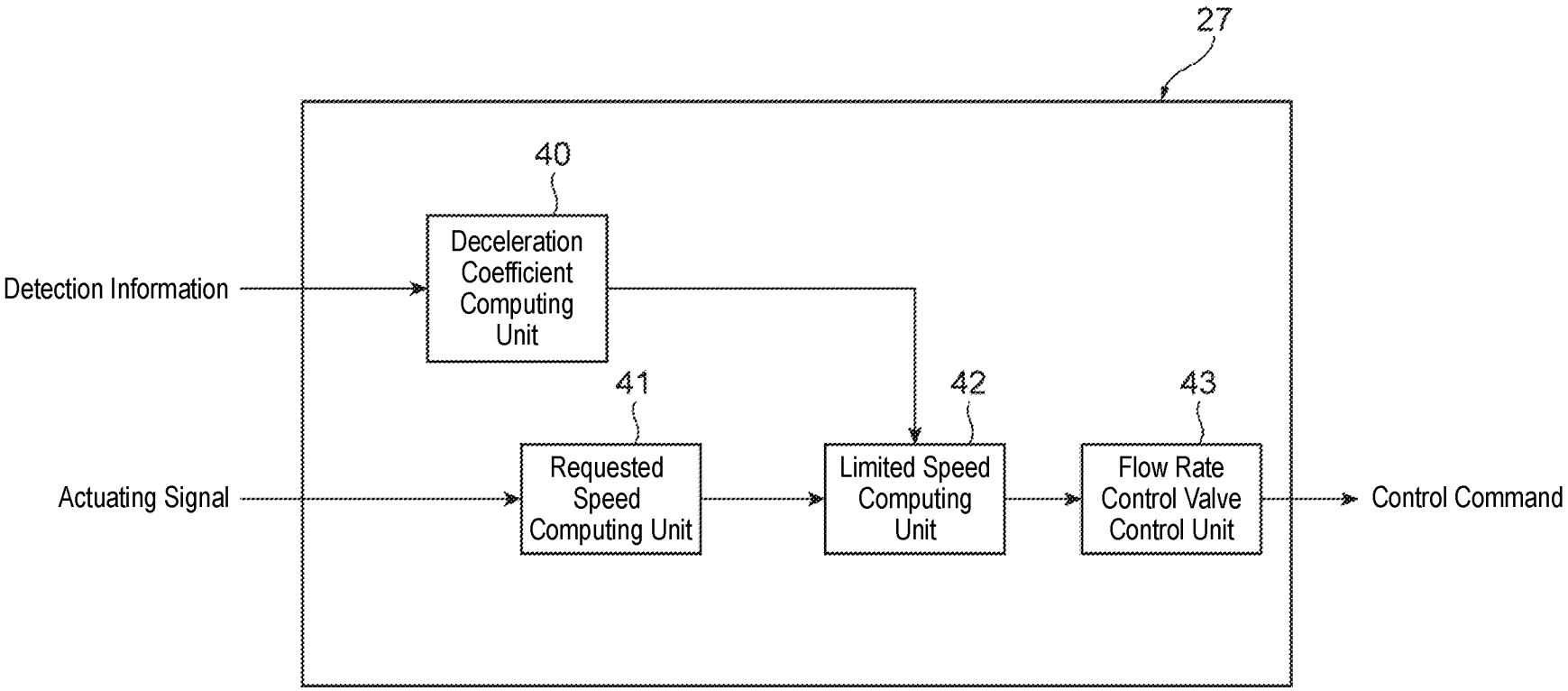
FIG. 7 is a block diagram illustrating the configuration of a controller related to the driving assistance function.

FIG. 7 is a block diagram illustrating the configuration of the controller related to the driving assistance function. As illustrated in FIG. 7, the driving assistance function of the controller 27 is implemented by a deceleration coefficient computing unit 40, a requested speed computing unit 41, a limited speed computing unit 42, and a flow rate control valve control unit 43.

The deceleration coefficient computing unit 40 computes the deceleration coefficient based on the detection information from the detection devices 25*a* to 25*d*. The requested speed computing unit 41 computes the requested speed for each actuator based on the operation amount of the operating lever 32 (i.e., an actuating signal output from the operating lever 32). The limited speed computing unit 42 computes the limited speed for each actuator by multiplying the deceleration coefficient output from the deceleration coefficient computing unit 40 by the requested speed output from the requested speed computing unit 41.

The flow rate control valve control unit 43 computes the control amount for the flow rate control valve corresponding to each actuator based on the limited speed output from the limited speed computing unit 42, and further outputs a control command to the proportional solenoid pressure-reducing valve corresponding to each actuator.

Figure 8:
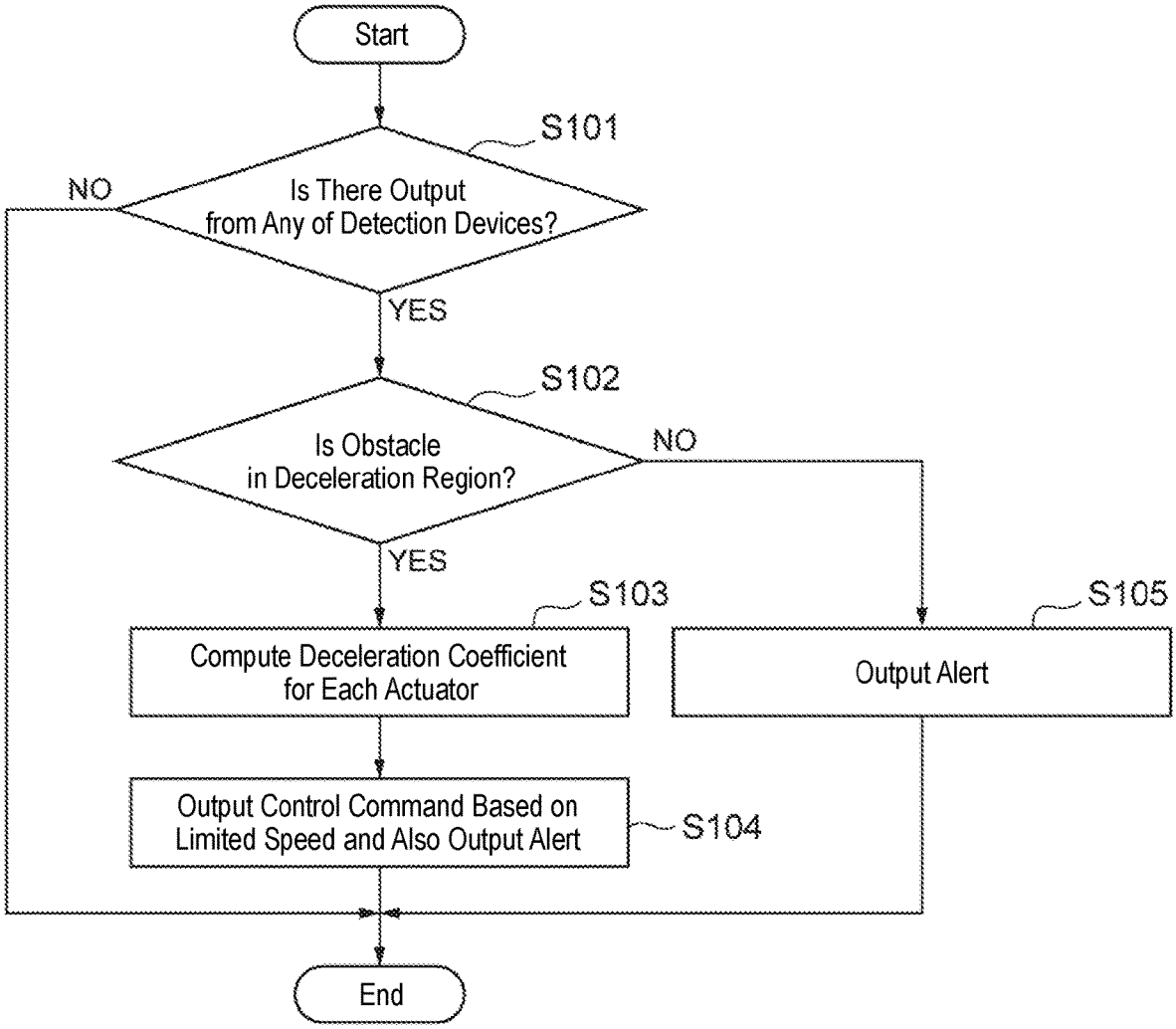
FIG. 8 is a flowchart illustrating a control process of the driving assistance function of the controller.

FIG. 8 is a flowchart illustrating a control process of the driving assistance function of the controller. As illustrated in FIG. 8, in step S101, the controller 27 determines if there is an output from any of the detection devices 25*a* to 25*d*. If it is determined that there is no output, the control process ends. Meanwhile, if it is determined that there is an output, the control process proceeds to step S102. In step S102, the controller 27 determines if the obstacle is in the deceleration region 39.

If it is determined that the obstacle is not in the deceleration region 39, the controller 27 sends a control command to the buzzer 28 to output an alert, and then, the buzzer 28 issues an alert with an alert volume set as illustrated in FIG. 5, for example (see step S105). Accordingly, the control process ends.

Meanwhile, if it is determined that the obstacle is in the deceleration region 39, the control process proceeds to step S103. In step S103, the deceleration coefficient computing unit 40 computes the deceleration coefficient for each actuator based on the distance between the hydraulic excavator and the obstacle as illustrated in FIG. 6, for example.

In step S104 following step S103, the controller 27 outputs a control command based on a limited speed and also outputs an alert. More specifically, at this time, the requested speed computing unit 41 computes the requested speed for each actuator based on the operation amount of the operating lever 32, and the limited speed computing unit 42 computes the limited speed for each actuator by multiplying the deceleration coefficient output from the deceleration coefficient computing unit 40 and the requested speed output from the requested speed computing unit 41.

The flow rate control valve control unit 43 computes the control amount for the flow rate control valve for each actuator based on the limited speed output from the limited speed computing unit 42, and outputs a control command to the proportional solenoid pressure-reducing valve corresponding to each actuator. In addition, the controller 27 sends a control command to the buzzer 28 to output an alert. Accordingly, the buzzer 28 issues an alert with an alert volume set as illustrated in FIG. 5, for example. Upon termination of step S104, the series of the control processes ends.

[Regarding Work Assistance Function of Hydraulic Excavator]

Next, the work assistance function of the hydraulic excavator 1 will be described. The work assistance function of the hydraulic excavator 1 is implemented based on the attitude information on the hydraulic excavator 1. Hereinafter, the attitude information on the hydraulic excavator 1 according to the present embodiment will be described first with reference to FIGS. 9 and 10.

Figure 9:
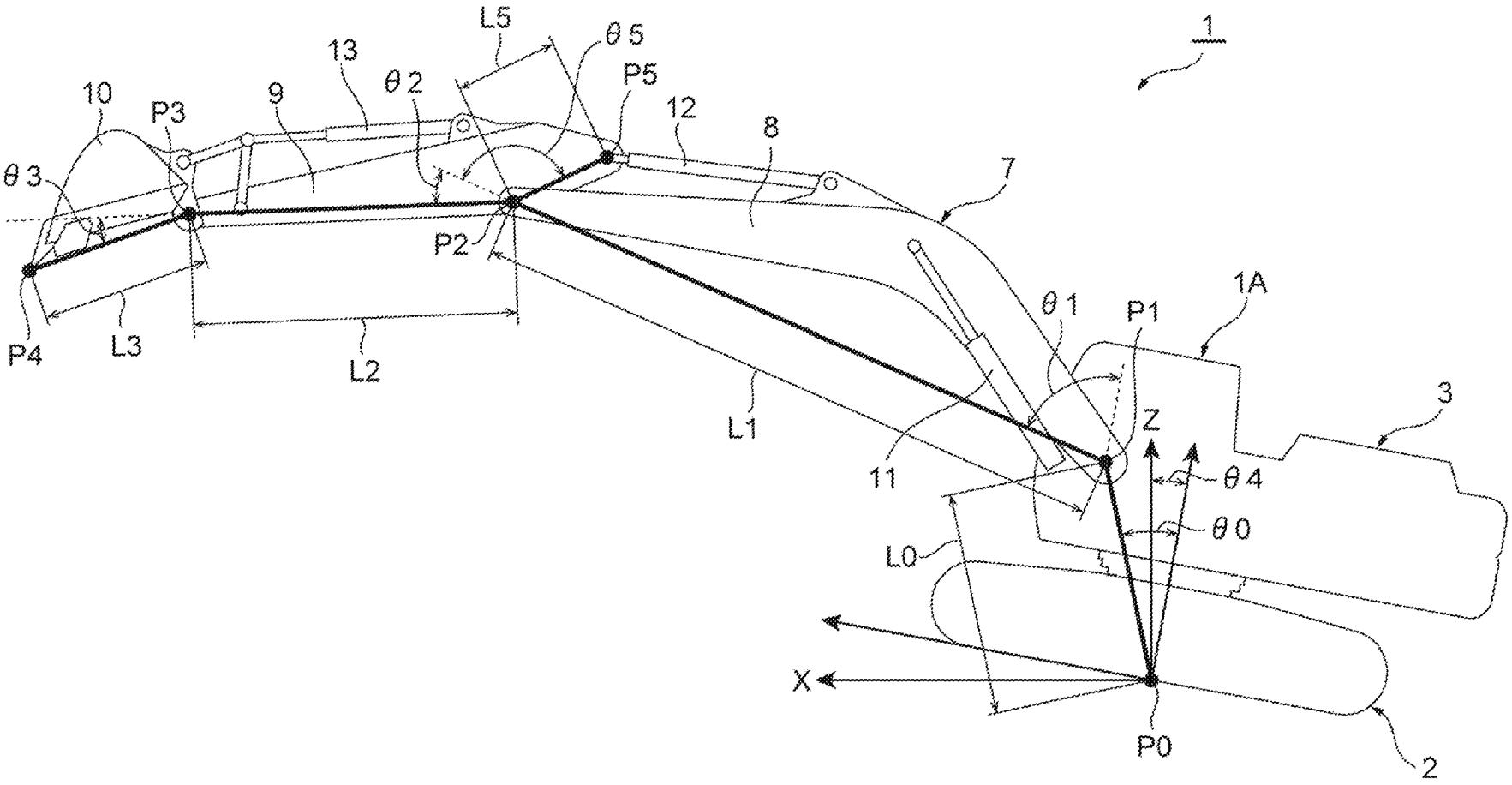
FIG. 9 is a side view for illustrating the attitude information on the hydraulic excavator.

FIG. 9 is a side view for illustrating the attitude information on the hydraulic excavator. The coordinate system illustrated in FIG. 9 is a local coordinate system in which a reference position P0 of the hydraulic excavator 1 is the origin, the horizontal direction is the X-axis, and the vertical direction is the Z-axis. It should be noted that the reference position P0 of the hydraulic excavator 1 on the global coordinate system can be determined from information of the first GNSS antenna 23 and the second GNSS antenna 24.

As illustrated in FIG. 9, the distance from the reference position P0 of the hydraulic excavator 1 to the boom pin P1 is L0. The angle made by a line segment connecting the reference position P0 and the boom pin P1 and the perpendicular direction of the vehicle body 1A (i.e., the up-down direction of the vehicle body 1A) is θ0. The length of the boom 8, that is, the distance from the boom pin P1 to the arm pin P2 is L1. The length of the arm 9, that is, the distance from the arm pin P2 to the bucket pin P3 is L2. The length of the bucket 10, that is, the distance from the bucket pin P3 to an end P4 of the claw of the bucket is L3.

The tilt of the vehicle body 1A on the local coordinate system, that is, the angle made by the Z-axis and the perpendicular direction of the vehicle body 1A is θ4. Hereinafter, such an angle shall be referred to as a vehicle body front-rear tilt θ4. The angle made by a line segment connecting the boom pin P1 and the arm pin P2 and the perpendicular direction of the vehicle body 1A is θ1. Hereinafter, such an angle shall be referred to as a boom angle θ1. The angle made by a line segment connecting the arm pin P2 and the bucket pin P3 and the line segment connecting the boom pin P1 and the arm pin P2 is θ2. Hereinafter, such an angle shall be referred to as an arm angle θ2. Further, the angle made by a line segment connecting the bucket pin P3 and the end P4 of the claw of the bucket and the line segment connecting the arm pin P2 and the bucket pin P3 is θ3. Hereinafter, such an angle shall be referred to as a bucket angle θ3.

Thus, when the end P4 of the claw of the bucket is the control target of work assistance, for example, the coordinates (i.e., the coordinates on the local coordinate system) of the end P4 of the claw of the bucket with respect to the reference position P0 can be determined using a trigonometric function based on the distance L0 from the reference position P0 to the boom pin P1, the angle θ0 made by the line segment connecting the reference position P0 and the boom pin P1 and the perpendicular direction of the vehicle body 1A, the vehicle body front-rear tilt θ4, the length L1 of the boom, the boom angle θ1, the length L2 of the arm, the arm angle θ2, the length L3 of the bucket, and the bucket angle θ3.

In addition, when a pin P5 on the rod side (i.e., the side adjacent to the arm 9) of the arm cylinder 12 is set as a control point, for example, the coordinates of the pin P5 can be determined using a trigonometric function based on, in addition to the aforementioned values, the distance L5 from the arm pin P2 to the pin P5 on the rod side of the arm cylinder and the angle θ5 made by the line segment connecting the boom pin P1 and the arm pin P2 and a line segment connecting the arm pin P2 and the pin P5 on the rod side of the arm cylinder.

Figure 10:
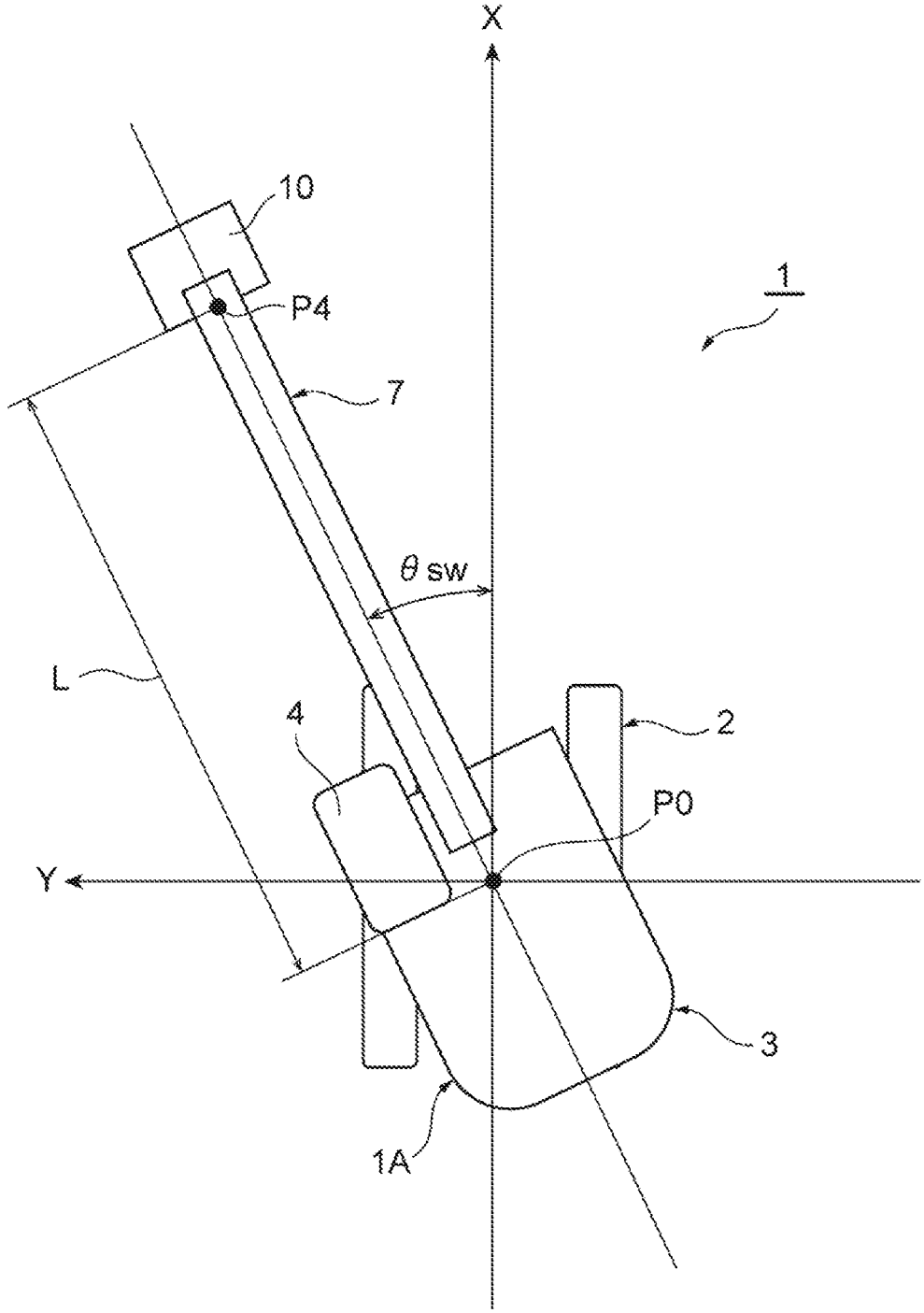
FIG. 10 is a plan view for illustrating the attitude information on the hydraulic excavator.

FIG. 10 is a plan view for illustrating the attitude information on the hydraulic excavator. As illustrated in FIG. 10, provided that the front-rear direction and the right-left direction of the hydraulic excavator 1 with respect to the reference position P0 thereof are the X-axis and the Y-axis, respectively, the swivel angle θsw of the hydraulic excavator 1 is the angle made by the extending direction of the work implement 7 and the X-axis, and the counterclockwise direction is assumed as the positive direction.

The coordinates of the end P4 of the claw of the bucket on the aforementioned local coordinate system can be determined using a trigonometric function of the distance L from the reference position P0 to the end P4 of the claw of the bucket and the swivel angle θsw. It should be noted that the distance L from the reference position P0 to the end P4 of the claw of the bucket can be determined with a trigonometric function using the aforementioned attitude information on the hydraulic excavator 1.

Next, the work range related to the work assistance function will be described with reference to FIGS. 11 and 12.

Figure 11:
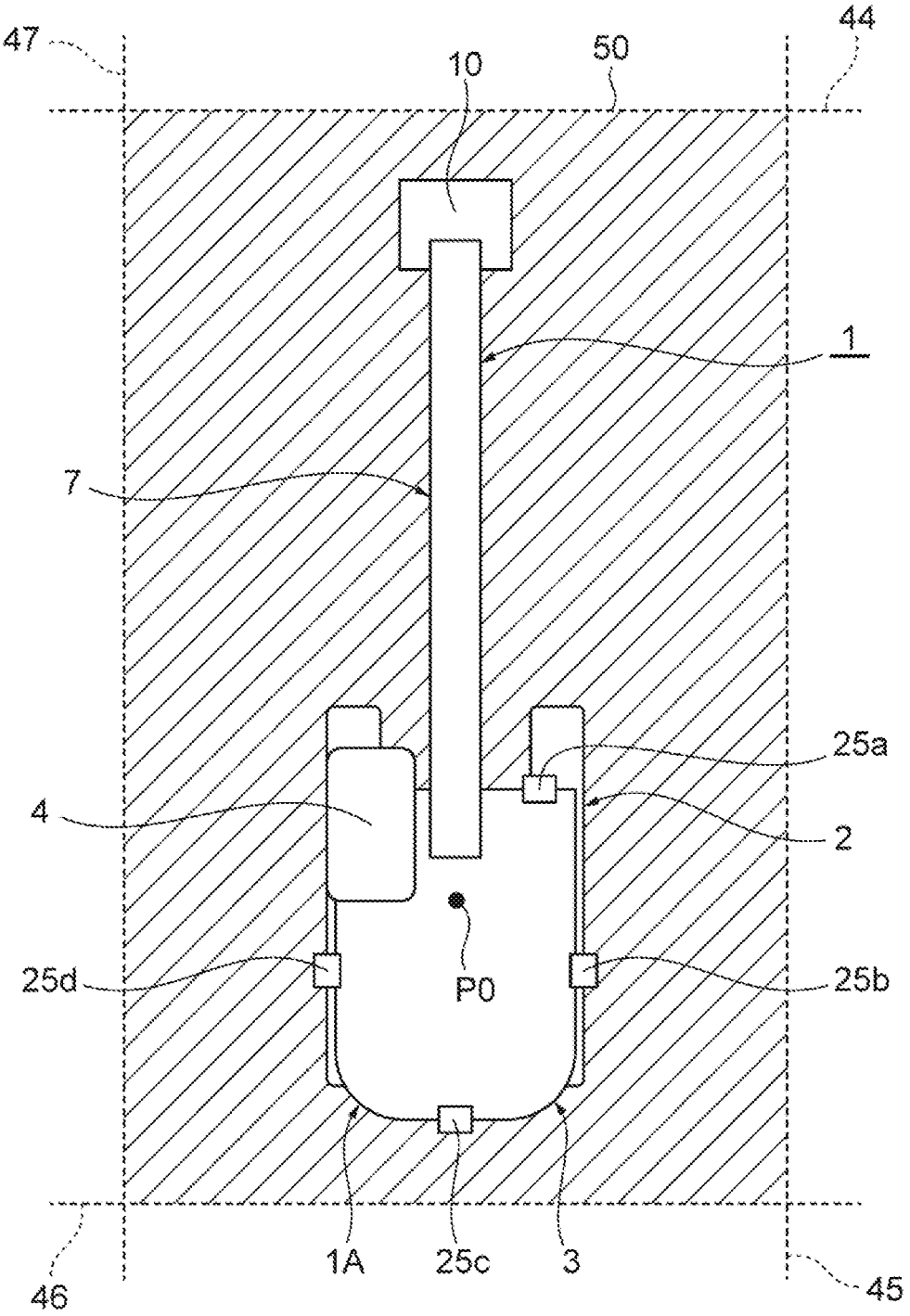
FIG. 11 is a view for illustrating a work range in the horizontal direction.

FIG. 11 is a view for illustrating the work range in the horizontal direction. As illustrated in FIG. 11, a region (i.e., a diagonally shaded region) 50 surrounded by a work range front outer edge 44, a work range right side outer edge 45, a work range rear outer edge 46, and a work range left side outer edge 47 with respect to the reference position P0 of the hydraulic excavator 1 is the work range of the hydraulic excavator 1 in the horizontal direction. During work, each actuator is controlled so as to prevent the control point of the hydraulic excavator 1 from deviating from the work range 50.

Herein, since the reference position P0 serves as the basis, when the hydraulic excavator 1 travels, the work range 50 also moves along with the movement of the hydraulic excavator 1. It should be noted that the work range 50 may also be defined by the global coordinates, and in such a case, the work range 50 is fixed even when the hydraulic excavator 1 has moved.

Figure 12:
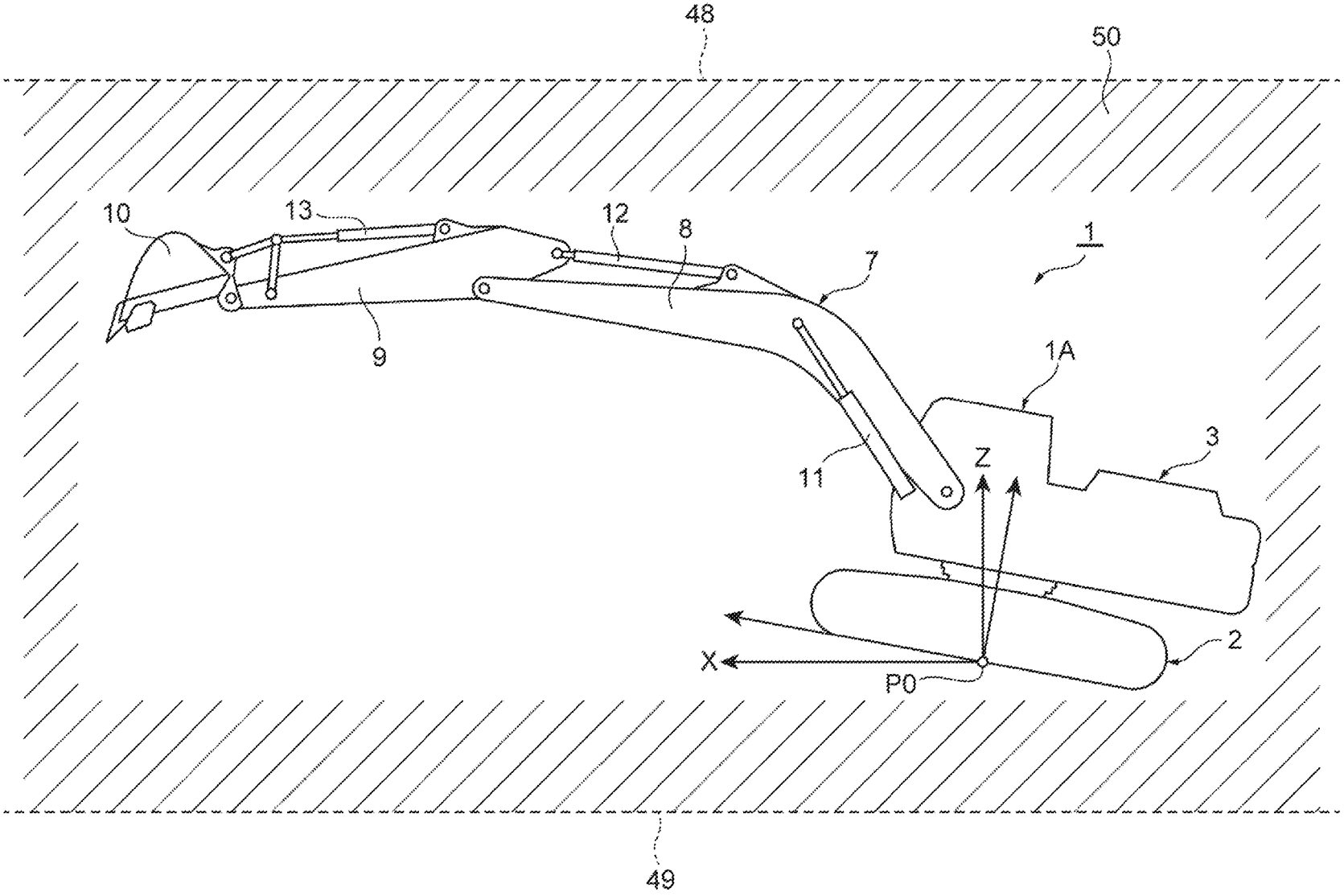
FIG. 12 is a view for illustrating a work range in the vertical direction.

FIG. 12 is a view for illustrating the work range in the vertical direction. As illustrated in FIG. 12, the region (i.e., the diagonally shaded region) 50 between a work range upper outer edge 48 and a work range lower outer edge 49 with respect to the reference position P0 in the vertical direction is the work range of the hydraulic excavator 1 in the vertical direction.

Figure 13:
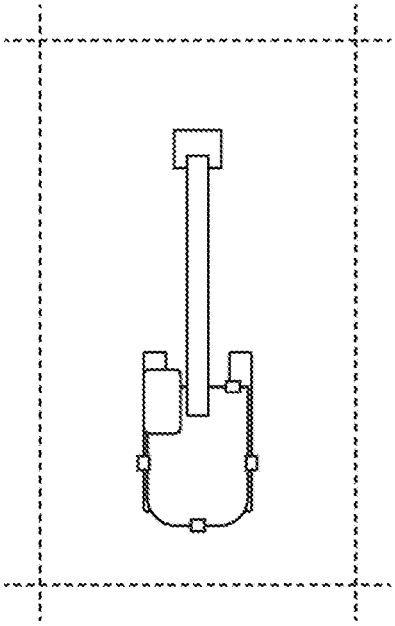
FIG. 13 is a view illustrating a work range setting screen on a monitor.
Figure 13:
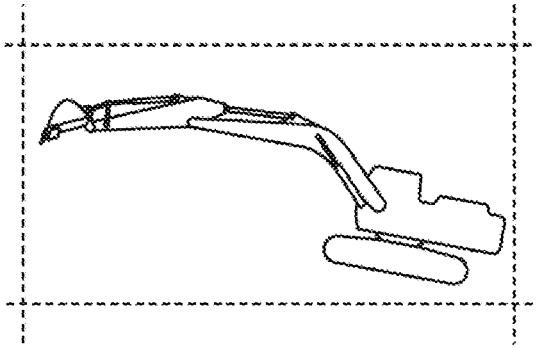

FIG. 13 is a view illustrating a work range setting screen on a monitor. As illustrated in FIG. 13, the operator is able to set the distance from the reference position P0 to the work range right side outer edge 45, the distance from the reference position P0 to the work range left side outer edge 47, the distance from the reference position P0 to the work range front outer edge 44, the distance from the reference position P0 to the work range rear outer edge 46, the distance from the reference position P0 to the work range upper outer edge 48, and the distance from the reference position P0 to the work range lower outer edge 49 via the monitor 31. That is, the operator sets each distance by inputting each value via the monitor 31. It should be noted that when no value is input, an infinite range is set. In addition, each actuator is not controlled in the direction for which no value is input.

Figure 14:
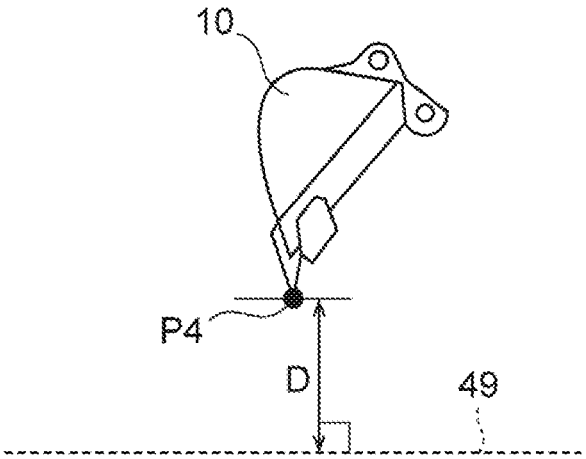
FIG. 14 is a diagram for illustrating a deceleration coefficient of a work assistance function.
Figure 14:
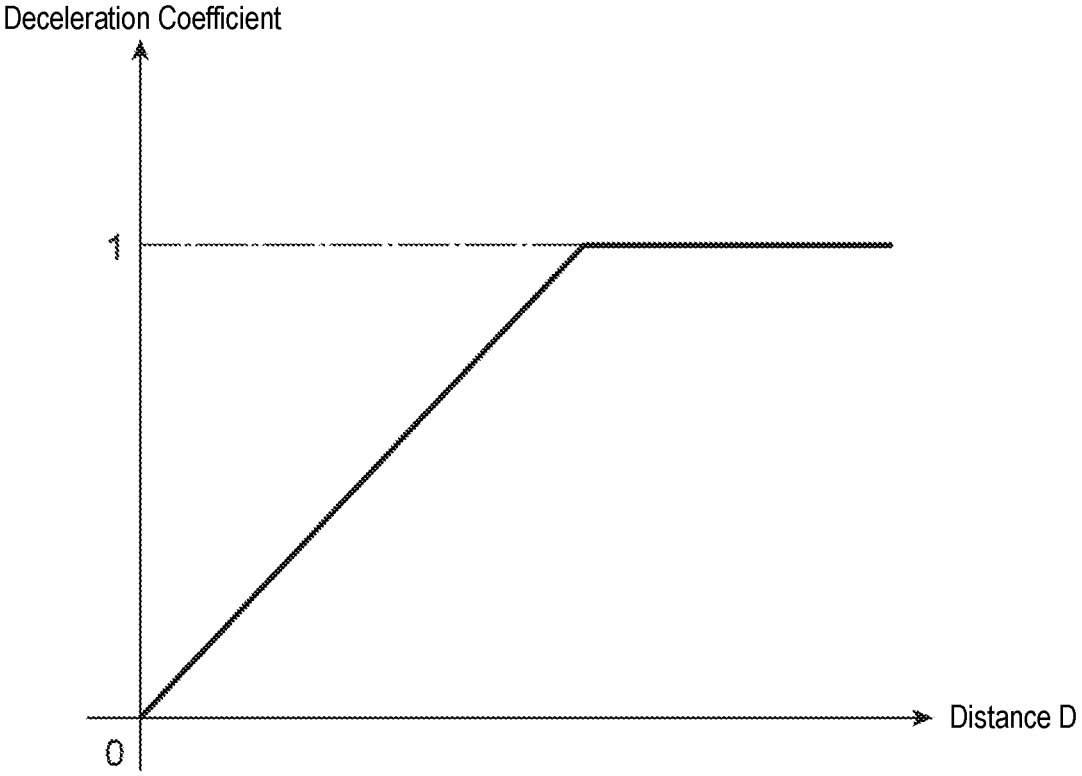

FIG. 14 is a diagram for illustrating the deceleration coefficient of the work assistance function. As illustrated in the upper view of FIG. 14, when the end P4 of the claw of the bucket approaches the work range lower outer edge 49, for example, the coordinates of the end P4 of the claw of the bucket are calculated with a trigonometric function using the aforementioned attitude information on the hydraulic excavator 1. The difference between the Z-axis coordinate of the end P4 of the claw of the bucket and the set distance of the work range lower outer edge 49 corresponds to the distance D between the end P4 of the claw of the bucket and the work range lower outer edge 49.

As illustrated in the lower graph of FIG. 14, the deceleration coefficient for decelerating the speed of approaching the work range outer edge is calculated according to the value of the distance D. Driving each actuator at a limited speed obtained through multiplication of the deceleration coefficient can prevent the control point of the hydraulic excavator 1 from deviating from the work range.

Meanwhile, when the pin P5 on the rod side of the arm cylinder 12 is set as a control point with respect to the work range upper outer edge 48, for example, it is possible to prevent the control point from deviating from the work range by performing similar calculation to that for the aforementioned end P4 of the claw of the bucket. It should be noted that when the operation of a plurality of work points is limited concurrently, each actuator is controlled in accordance with the smallest limited speed.

Figure 15:
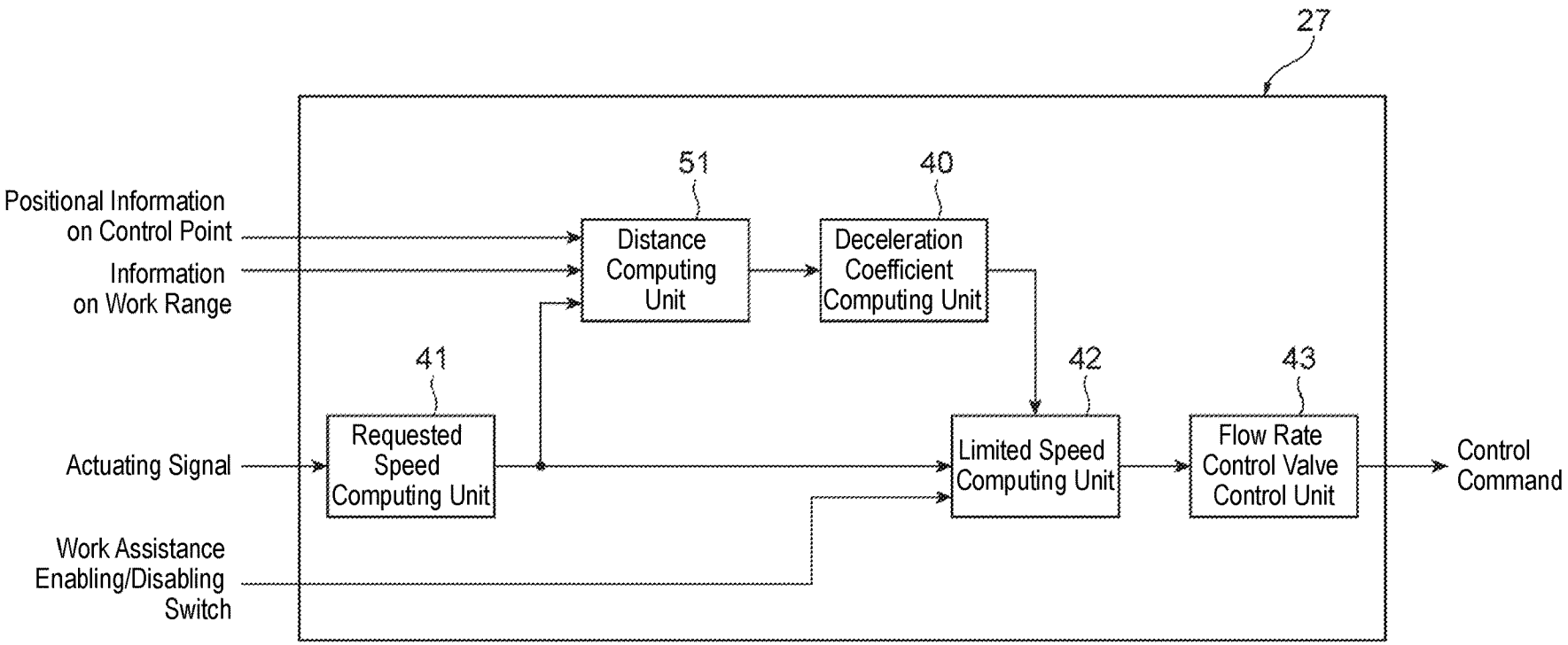
FIG. 15 is a block diagram illustrating the configuration of the controller related to the work assistance function.

FIG. 15 is a block diagram illustrating the configuration of the controller related to the work assistance function. As illustrated in FIG. 15, the work assistance function of the controller 27 is implemented by a distance computing unit 51, the deceleration coefficient computing unit 40, the requested speed computing unit 41, the limited speed computing unit 42, and the flow rate control valve control unit 43.

The requested speed computing unit 41 computes the requested speed for each actuator based on the operation amount of the operating lever 32 (i.e., an actuating signal output from the operating lever 32). The distance computing unit 51 computes the distance between a control point and a work range outer edge based on the positional information on the control point (for example, the coordinates of the control point), the information on the work range, and the requested speed output from the requested speed computing unit 41. Herein, the requested speed is used to calculate the movement direction of the control point, and the distance between the control point and the work range outer edge lying along the movement direction of the control point is computed.

The deceleration coefficient computing unit 40 computes the deceleration coefficient for each actuator based on the distance output from the distance computing unit 51. The limited speed computing unit 42 computes the limited speed for each actuator based on the deceleration coefficient output from the deceleration coefficient computing unit 40, the requested speed output from the requested speed computing unit 41, and the output of the work assistance enabling/disabling switch 29. The flow rate control valve control unit 43 computes the control amount for the flow rate control valve corresponding to each actuator based on the limited speed output from the limited speed computing unit 42, and further outputs a control command to the proportional solenoid pressure-reducing valve corresponding to each actuator.

Figure 16:
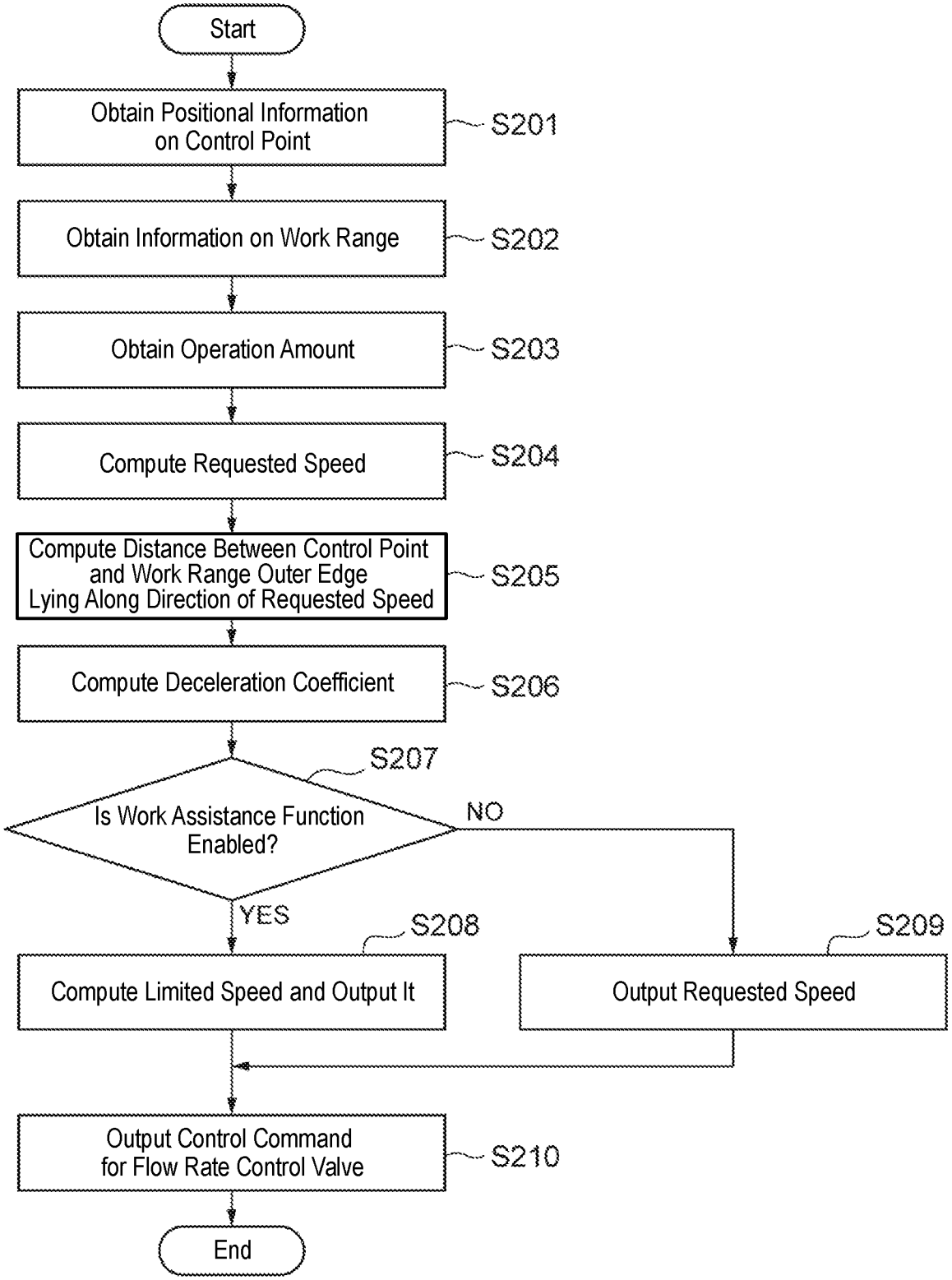
FIG. 16 is a flowchart illustrating a control process of the work assistance function of the controller.

FIG. 16 is a flowchart illustrating a control process of the work assistance function of the controller. As illustrated in FIG. 16, in step S201, the controller 27 obtains the positional information on a control point from the vehicle body tilt sensor 18, the boom tilt sensor 19, the arm tilt sensor 20, and the bucket tilt sensor 21. In step S202 following step S201, the controller 27 obtains the information on the work range 50 input to and set on the monitor 31 by the operator.

In step S203 following step S202, the controller 27 obtains the operation amount from the operating lever 32. In step S204 following step S203 the requested speed computing unit 41 computes the requested speed for each actuator based on the operation amount of the operating lever 32 obtained in step S203.

In step S205 following step S204, the distance computing unit 51 computes the distance between the control point and the work range outer edge lying along the direction of the requested speed based on the positional information on the control point, the information on the work range 50, and the requested speed output from the requested speed computing unit 41. In step S206 following step S205, the deceleration coefficient computing unit 40 computes the deceleration coefficient for each actuator based on the distance computed in step S205.

In step S207 following step S206, the controller 27 determines if the work assistance function is enabled. It should be noted that the work assistance function is switched between enabled and disabled by the operator through operation of the work assistance enabling/disabling switch 29. If it is determined that the work assistance function is not enabled (that is, if the work assistance function is switched to disabled), the control process proceeds to step S209. In step S209, the controller 27 outputs the requested speed of each actuator computed in step S204.

Meanwhile, if it is determined that the work assistance function is enabled (that is, if the work assistance function is switched to enabled), the control process proceeds to step S208. In step S208, the limited speed computing unit 42 computes the limited speed for each actuator based on the requested speed computed in step S204, the deceleration coefficient computed in step S206, and the like, and outputs the computed limited speed.

In step S210 following step S208 or step S209, the flow rate control valve control unit 43 computes the control amount for the flow rate control valve corresponding to each actuator based on the limited speed output in step S208 or the requested speed output in step S209, and further outputs a control command to the proportional solenoid pressure-reducing valve corresponding to each actuator. Upon termination of step S210, the series of the control processes ends.

[Regarding Driving Assistance Function and Work Assistance Function of Hydraulic Excavator]

Next, the driving assistance function and the work assistance function of the hydraulic excavator 1 will be described.

Figure 17:
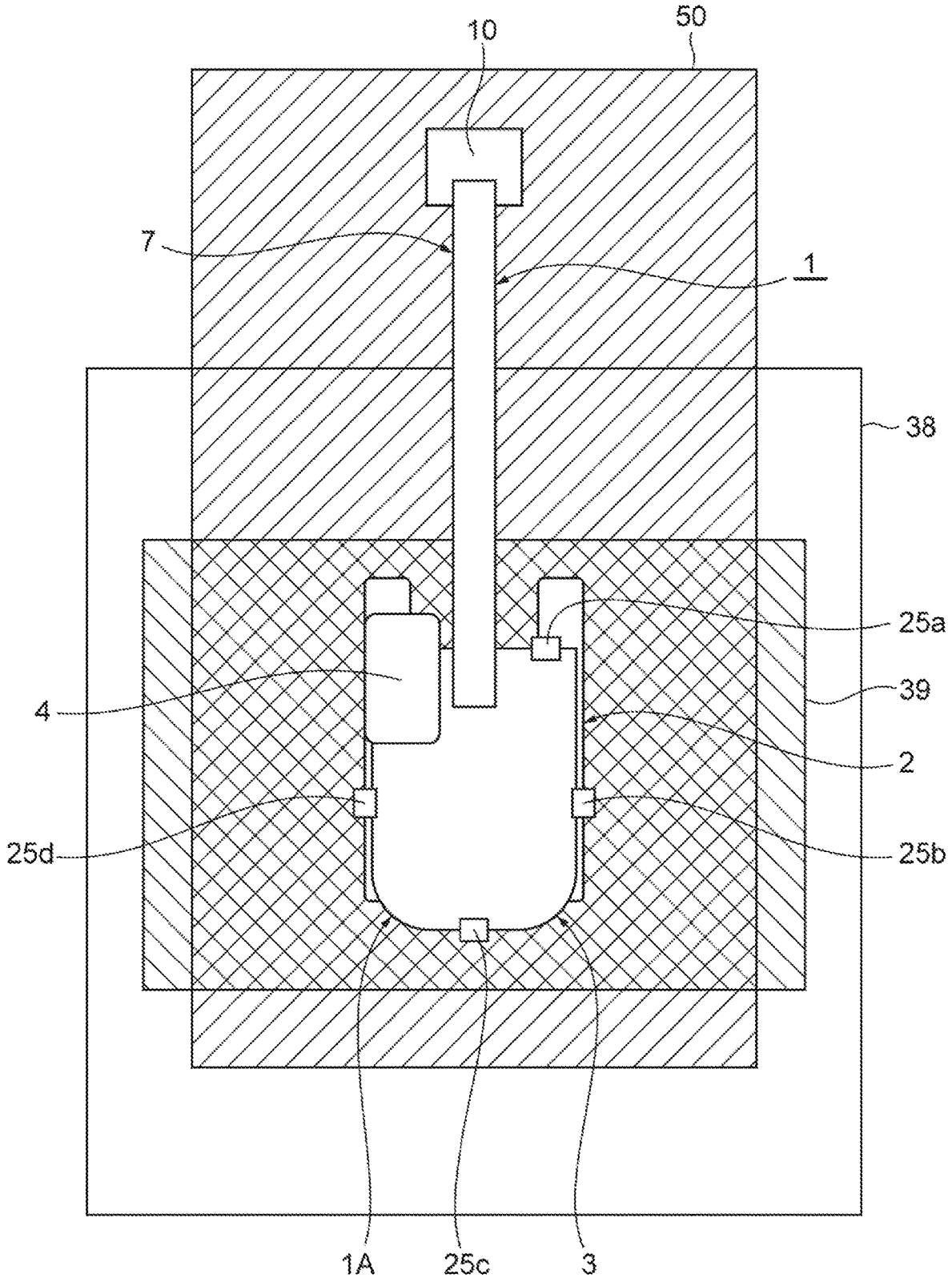
FIG. 17 is a view for illustrating a case where an alert region, a deceleration region, and a work range are set.

FIG. 17 is a view for illustrating a case where the alert region, the deceleration region, and the work range are set. In FIG. 17, the diagonally shaded region 39 is the deceleration region, the region 38 within a quadrangular frame is the alert region, and the diagonally shaded region 50 is the work range. In the example of FIG. 17, each of the alert region 38 and the deceleration region 39 has a region overlapping the work range 50 and a region not overlapping the work range 50.

Figure 18:
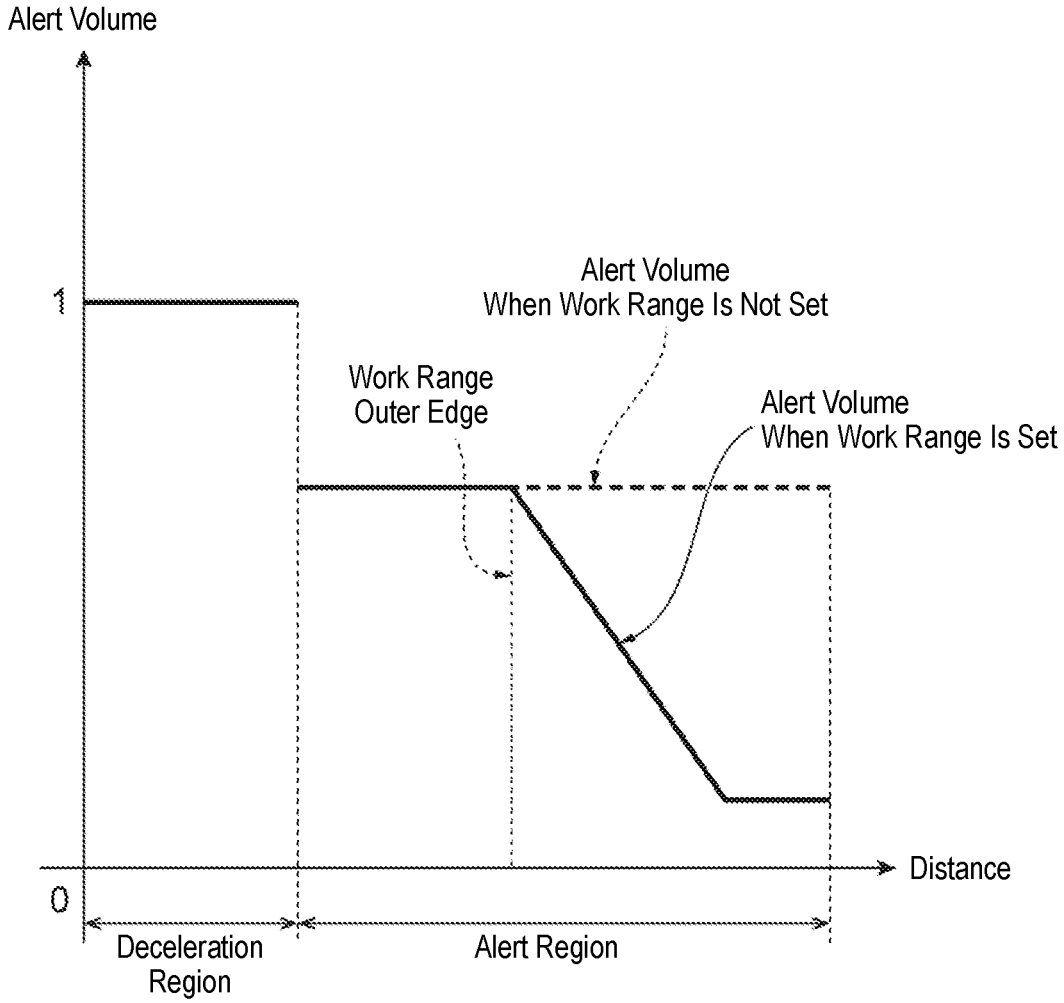
FIG. 18 is a graph illustrating the relationship between the distance between the hydraulic excavator and an obstacle and the alert volume in an embodiment.

FIG. 18 is a graph illustrating the relationship between the distance between the hydraulic excavator and an obstacle and the alert volume in an embodiment. In FIG. 18, the "distance" of the abscissa axis is the abbreviation of the distance between the hydraulic excavator and an obstacle. As illustrated in FIG. 18, the alert volume in the alert region on the outer side of the work range outer edge is set such that it is smaller when the work range is set (that is, when the work assistance function is switched to enabled) than when the work range is not set (that is, when the work assistance function is switched to disabled).

Accordingly, the alert function (i.e., the driving assistance function) outside of the work range is suppressed (that is, the alert volume is set smaller) when the work range is set in comparison with when the work range is not set. Preferably, in the alert region on the outer side of the work range outer edge, as the distance between an obstacle and the work range outer edge is shorter, the degree of suppressing the alert function is smaller. That is, as the distance between an obstacle and the work range outer edge is shorter, the degree of lowering the alert volume is smaller.

Figure 19:
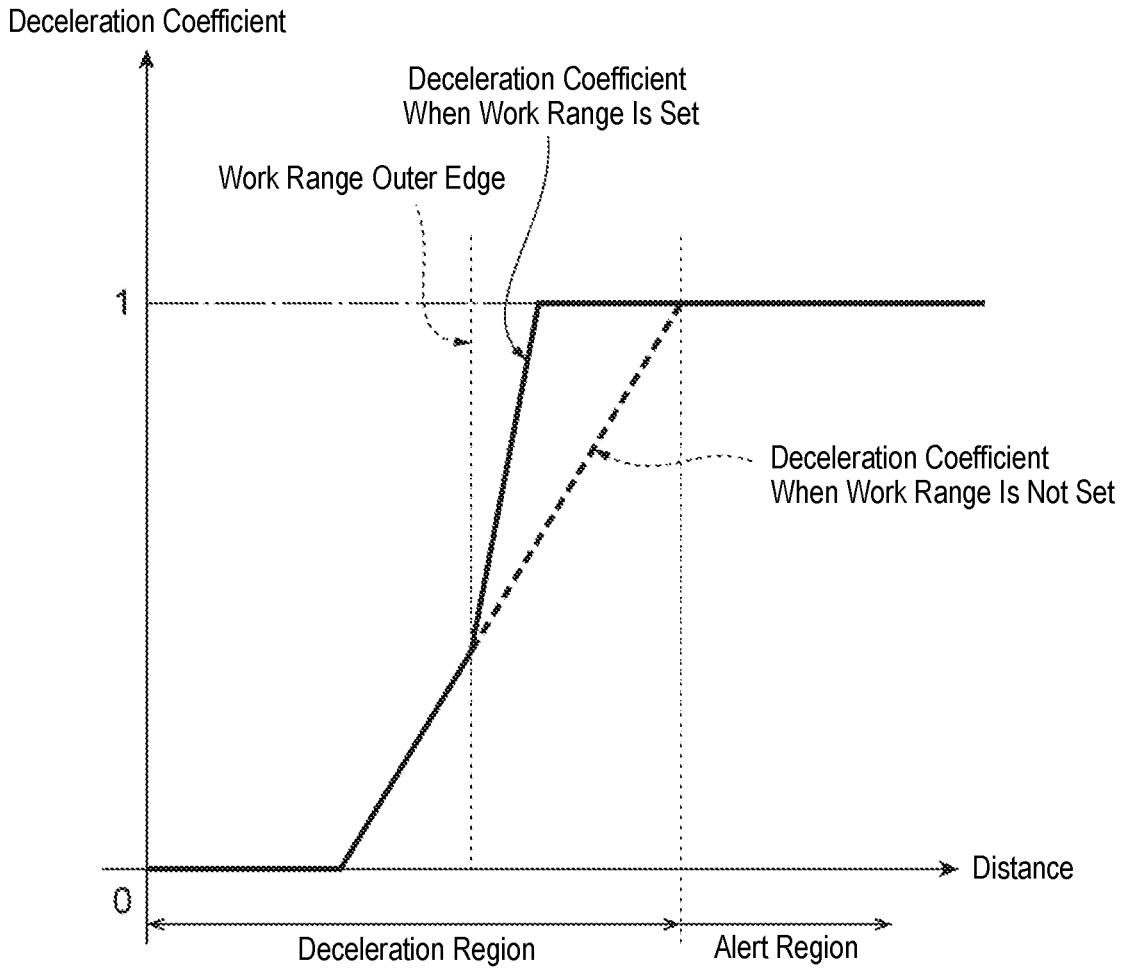
FIG. 19 is a graph illustrating the relationship between the distance between the hydraulic excavator and an obstacle and a deceleration coefficient in an embodiment.

FIG. 19 is a graph illustrating the relationship between the distance between the hydraulic excavator and an obstacle and the deceleration coefficient in an embodiment. In FIG. 19, the "distance" of the abscissa axis is the abbreviation of the distance between the hydraulic excavator and an obstacle. As illustrated in FIG. 19, the deceleration coefficient in the deceleration region on the outer side of the work range outer edge is set such that it is larger when the work range is set (that is, when the work assistance function is switched to enabled) than when the work range is not set (that is, when the work assistance function is switched to disabled).

Accordingly, the deceleration function (i.e., the driving assistance function) outside of the work range is suppressed (that is, the deceleration is set smaller) when the work range is set in comparison with when the work range is not set. Preferably, in the deceleration region on the outer side of the work range outer edge, as the distance between an obstacle and the work range outer edge is shorter, the degree of suppressing the deceleration function is smaller. That is, as the distance between an obstacle and the work range outer edge is shorter, the deceleration is lower.

Figure 20:
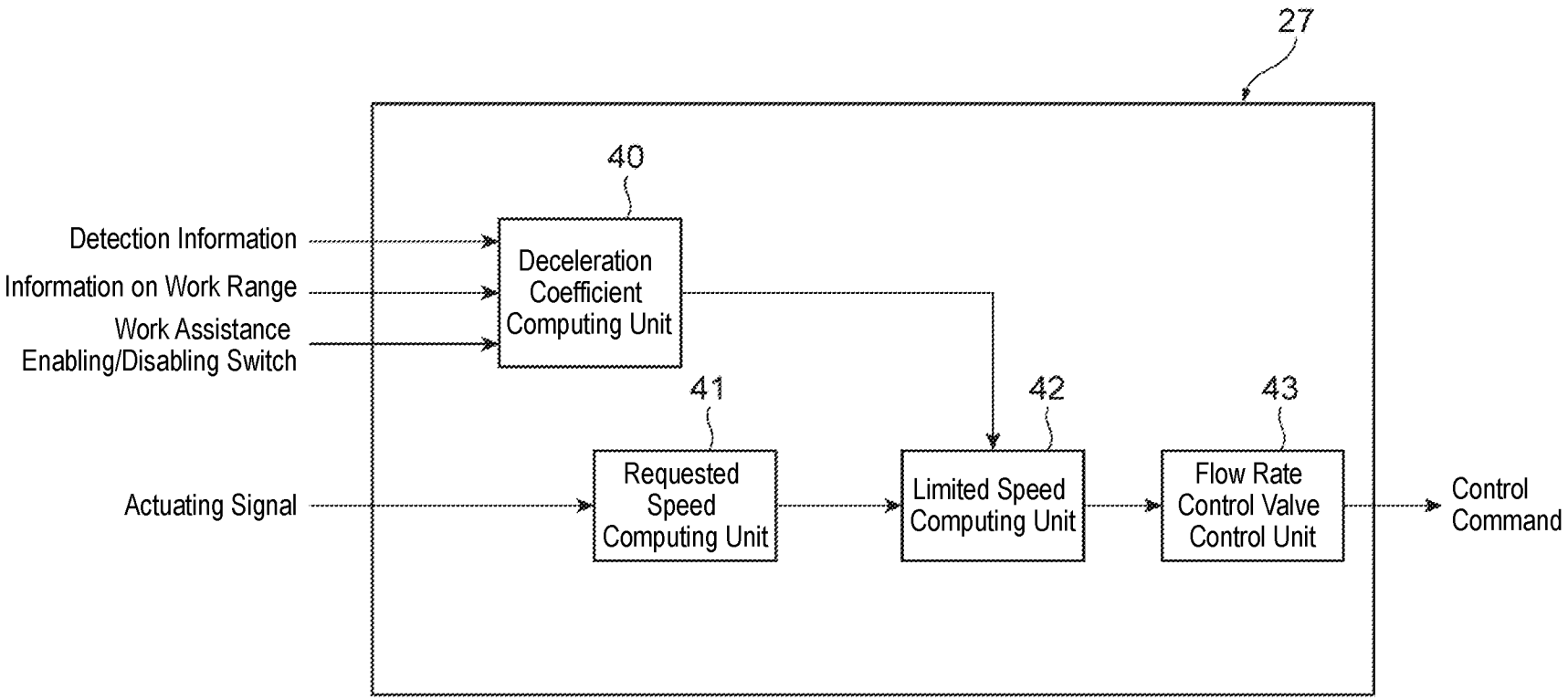
FIG. 20 is a block diagram illustrating the configuration of the controller related to the driving assistance function and the work assistance function in an embodiment.

FIG. 20 is a block diagram illustrating the configuration of the controller related to the driving assistance function and the work assistance function in an embodiment. As illustrated in FIG. 20, the driving assistance function and the work assistance function of the controller 27 are implemented by the deceleration coefficient computing unit 40, the requested speed computing unit 41, the limited speed computing unit 42, and the flow rate control valve control unit 43.

The deceleration coefficient computing unit 40 computes the deceleration coefficient for each actuator based on the detection information from the detection devices 25*a* to 25*d*, the information on the work range 50, and the output of the work assistance enabling/disabling switch 29. The requested speed computing unit 41 computes the requested speed for each actuator based on the operation amount of the operating lever 32.

The limited speed computing unit 42 computes the limited speed for each actuator based on the deceleration coefficient output from the deceleration coefficient computing unit 40 and the requested speed output from the requested speed computing unit 41. The flow rate control valve control unit 43 computes the control amount for the flow rate control valve corresponding to each actuator based on the limited speed output from the limited speed computing unit 42, and further outputs a control command to the proportional solenoid pressure-reducing valve corresponding to each actuator.

Figure 21:
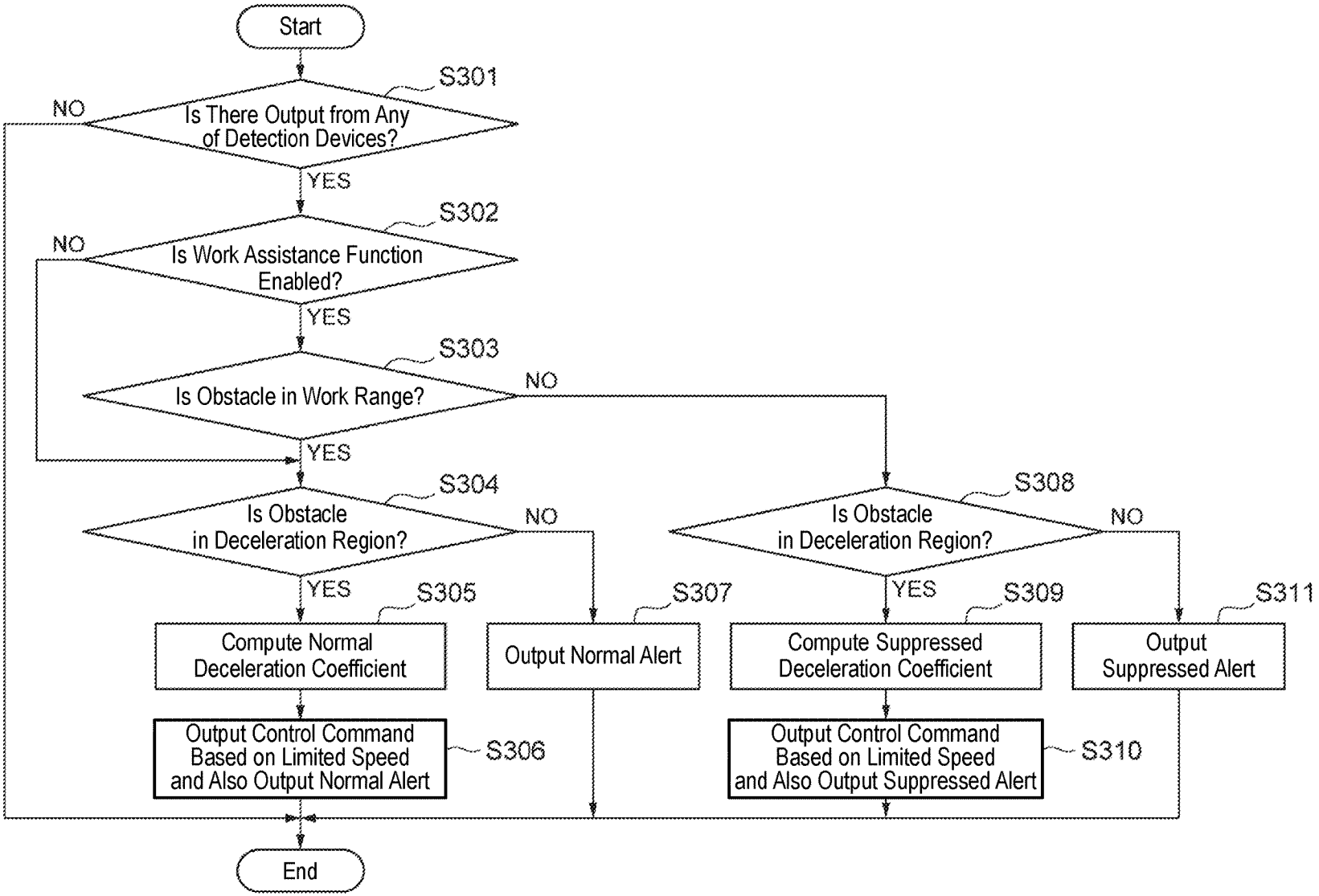
FIG. 21 is a flowchart illustrating a control process of the driving assistance function and the work assistance function of the controller.

FIG. 21 is a flowchart illustrating a control process of the driving assistance function and the work assistance function of the controller. As illustrated in FIG. 21, in step S301, the controller 27 determines if there is an output from any of the detection devices 25*a* to 25*d*. If it is determined that there is no output, the control process ends. Meanwhile, if it is determined that there is an output, the control process proceeds to step S302. In step S302, the controller 27 determines if the work assistance function is enabled. At this time, the controller 27 performs the determination based on a signal output from the work assistance enabling/disabling switch 29.

If it is determined that the work assistance function is not enabled (that is, if the work assistance function is switched to disabled or if the work range is not set), the control process proceeds to step S304 described below. Meanwhile, if it is determined that the work assistance function is enabled (that is, if the work assistance function is switched to enabled or if the work range is set), the control process proceeds to step S303. In step S303, the controller 27 determines if the obstacle is in the work range 50. If it is determined that the obstacle is not in the work range 50, the control process proceeds to step S308 described below.

Meanwhile, if it is determined that the obstacle is in the work range 50, the control process proceeds to step S304. In step S304, the controller 27 determines if the obstacle is in the deceleration region 39. If it is determined that the obstacle is not in the deceleration region 39, the controller 27 sends a control command to the buzzer 28 to output a normal alert, and then, the buzzer 28 issues an alert with the set alert volume (see step S307). Accordingly, the control process ends. It should be noted that the "normal alert" herein is the alert set in step S105 of the aforementioned control process of driving assistance, that is, the alert set in the normal driving assistance as illustrated in FIG. 5.

Meanwhile, if it is determined that the obstacle is in the deceleration region 39 in step S304, the control process proceeds to step S305. In step S305, the deceleration coefficient computing unit 40 computes the normal deceleration coefficient for each actuator based on the distance between the hydraulic excavator and the obstacle. The "normal deceleration coefficient" herein is the deceleration coefficient computed in step S103 of the aforementioned control process of driving assistance, that is, the deceleration coefficient when the normal driving assistance is performed as illustrated in FIG. 6.

In step S306 following step S305, the controller 27 outputs a control command based on a limited speed and also outputs a normal alert. More specifically, at this time, the requested speed computing unit 41 computes the requested speed for each actuator based on the operation amount of the operating lever 32, and the limited speed computing unit 42 computes the limited speed for each limited speed based on the deceleration coefficient output from the deceleration coefficient computing unit 40 and the requested speed output from the requested speed computing unit 41.

The flow rate control valve control unit 43 computes the control amount for the flow rate control valve corresponding to each actuator based on the limited speed output from the limited speed computing unit 42, and outputs a control command to the proportional solenoid pressure-reducing valve corresponding to each actuator. In addition, the controller 27 sends a control command to the buzzer 28 to output an alert. Accordingly, the buzzer 28 issues a normal alert set as illustrated in FIG. 5, for example. Upon termination of step S306, the series of the control processes ends.

Meanwhile, if it is determined that the obstacle is not in the work range in step S303 described above, the control process proceeds to step S308. In step S308, the controller 27 determines if the obstacle is in the deceleration region 39. If it is determined that the obstacle is not in the deceleration region 39, the controller 27 sends a control command to the buzzer 28 to output a suppressed alert, and then, the buzzer 28 issues a suppressed alert (see step S311). Accordingly, the control process ends. It should be noted that the "suppressed alert" herein is an alert with a smaller volume than that of the alert set when the normal driving assistance is performed, and is an alert with a volume set as illustrated in FIG. 18, for example.

Meanwhile, if it is determined that the obstacle is in the deceleration region 39 in step S308, the control process proceeds to step S309. In step S309, the deceleration coefficient computing unit 40 computes the suppressed deceleration coefficient for each actuator based on the distance between the hydraulic excavator and the obstacle. The "suppressed deceleration coefficient" herein is a deceleration coefficient larger than that when the normal driving assistance is performed (i.e., a coefficient for suppressing the deceleration), and is a deceleration coefficient set as illustrated in FIG. 19, for example.

In step S310 following step S309, the controller 27 outputs a control command based on a limited speed and also outputs a suppressed alert. More specifically, at this time, the requested speed computing unit 41 computes the requested speed for each actuator based on the operation amount of the operating lever 32, and the limited speed computing unit 42 computes the limited speed for each actuator based on the suppressed deceleration coefficient from the deceleration coefficient computing unit 40 and the requested speed output from the requested speed computing unit 41.

The flow rate control valve control unit 43 computes the control amount for the flow rate control valve corresponding to each actuator based on the limited speed output from the limited speed computing unit 42, and outputs a control command to the proportional solenoid pressure-reducing valve corresponding to each actuator. In addition, the controller 27 sends a control command to the buzzer 28 to output a suppressed alert. Accordingly, the buzzer 28 issues a suppressed alert. Upon termination of step S310, the series of the control processes ends.

With the hydraulic excavator 1 according to the present embodiment, when the work assistance function is determined to be enabled, even if there is an obstacle in the deceleration region 39 but outside of the work range 50, the controller 27 increases the deceleration coefficient or reduces the alert volume for each actuator in comparison with when the work assistance function is determined to be disabled, and thus can reduce cumbersomeness for the operator and prevent a decrease in work efficiency.

In addition, when the work assistance function is determined to be enabled, if there is an obstacle outside of the work range 50 and outside of the deceleration region 39, the controller 27 suppresses an alert in comparison with when the work assistance function is determined to be disabled, and thus can reduce cumbersomeness for the operator and prevent a decrease in work efficiency.

Although the embodiments of the present invention have been described in detail above, the present invention is not limited thereto, and various design changes are possible within the spirit and scope of the present invention recited in the appended claims.

REFERENCE SIGNS LIST

1 Hydraulic excavator
7 Work implement
25*a* Front detection device
25*b* Right side detection device
25*c* Rear detection device
25*d* Left side detection device
26*a* Font detectable range

26*b* Right side detectable range
26*c* Rear detectable range
26*d* Left side detectable range
27 Controller
28 Buzzer
29 Work assistance enabling/disabling switch
30 Attitude sensor
31 Monitor
32 Operating lever
38 Alert region
39 Deceleration region
44 Work range front outer edge
45 Work range right side outer edge
46 Work range rear outer edge
47 Work range left side outer edge
48 Work range upper outer edge
49 Work range lower outer edge
50 Work range
51 Distance computing unit

The invention claimed is:

1. A work machinery comprising:

a work implement as a work front;

a detection device configured to detect an obstacle around the work machinery; and a controller configured to control an operation of at least the work implement, wherein:

the controller has a driving assistance function and a work assistance function, the driving assistance function being adapted to, when an obstacle detected by the detection device is in a preset monitoring range, decelerate the work implement or alert an operator, or perform both, and the work assistance function being adapted to prevent the work implement from deviating from a preset work range, the work assistance function is switchable between enabled and disabled, and when the work assistance function is switched to enabled, the controller is configured to, for an obstacle detected in the monitoring range but outside of the work range, suppress the driving assistance function in comparison with when the work assistance function is switched to disabled.

2. The work machinery according to claim 1, wherein the controller is configured to change a degree of suppressing the driving assistance function based on a distance between the obstacle detected by the detection device and an outer edge of the work range.

3. The work machinery according to claim 1, wherein the controller is configured to, as a distance between the obstacle detected by the detection device and an outer edge of the work range is shorter, reduce a degree of suppressing the driving assistance function.

* * * * *